US007735923B2

(12) United States Patent
Roslund et al.

(10) Patent No.: US 7,735,923 B2
(45) **Date of Patent: *Jun. 15, 2010**

(54) TILT CONTROL MECHANISM FOR A CHAIR

(75) Inventors: Richard N. Roslund, Jenison, MI (US); Matthew Rutman, Howell, MI (US); VijayKrishna Gundarapu, Holland, MI (US); Naveen Guntur, Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/381,243

(22) Filed: Mar. 10, 2009

(65) Prior Publication Data

US 2009/0179473 A1 Jul. 16, 2009

Related U.S. Application Data

(60) Continuation of application No. 12/150,847, filed on May 1, 2008, now Pat. No. 7,513,570, which is a division of application No. 11/598,166, filed on Nov. 10, 2006, now Pat. No. 7,429,081, which is a continuation of application No. PCT/US2006/007820, filed on Mar. 1, 2006.

(60) Provisional application No. 60/657,541, filed on Mar. 1, 2005, provisional application No. 60/689,723, filed on Jun. 10, 2005.

(51) Int. Cl.
*A47C 1/024* (2006.01)
*A47C 1/038* (2006.01)
*A47C 3/026* (2006.01)

(52) U.S. Cl. ..... 297/300.2; 297/300.4; 297/300.5; 297/300.6

(58) Field of Classification Search ..... 297/300.2, 297/300.4, 300.5, 300.6
See application file for complete search history.

(56) References Cited

U.S. PATENT DOCUMENTS 218,972 A 8/1879 Hollstegge et al.

(Continued)

FOREIGN PATENT DOCUMENTS

WO WO 96/39897 12/1996

OTHER PUBLICATIONS

International Search Report and Written Opinion dated Jul. 21, 2006.

*Primary Examiner*—Rodney B White
(74) *Attorney, Agent, or Firm*—Flynn, Thiel, Boutell & Tanis, P.C.

(57) ABSTRACT

A tilt control mechanism for an office chair includes a spring assembly therein which controls the tilt tension on the back assembly. The tilt control mechanism includes a control plate mounted to the control shaft on which the uprights are mounted, wherein the control plate rotates in combination with the uprights. This control plate is located within the control body and cooperates with a front stop assembly and a back stop assembly to vary the limits of forward and rearward tilting of the seat and back assemblies. Also, the tilt control mechanism includes a pneumatic actuator assembly having fixed and rotatable cam blocks. The rotatable cam block rotates relative to the fixed block such that the rotatable cam block is driven downwardly to depress the control valve of the pneumatic cylinder and thereby vary the height of the seat assembly.

37 Claims, 41 Drawing Sheets

U.S. PATENT DOCUMENTS 2,446,127 A 7/1948 Cramer
3,434,756 A 3/1969 Walkinshaw
3,659,819 A 5/1972 Wolters
3,710,645 A 1/1973 Bennett
3,880,465 A 4/1975 Scheben
4,072,288 A 2/1978 Wirges et al.
4,384,741 A 5/1983 Flum et al.
4,669,330 A 6/1987 Stocker
4,709,963 A 12/1987 Uecker et al.
4,720,142 A 1/1988 Holdredge et al.
4,779,925 A 10/1988 Heinzel
4,805,479 A 2/1989 Brightwell
4,840,426 A 6/1989 Vogtherr et al.
4,854,185 A 8/1989 Lichtenberg et al.
4,943,115 A 7/1990 Stucki
5,004,214 A 4/1991 Marchina
5,026,117 A 6/1991 Faiks et al.
5,106,157 A 4/1992 Nagelkirk et al.
5,192,114 A 3/1993 Hollington et al.
5,259,663 A 11/1993 Ambasz
5,289,794 A 3/1994 Jerro et al.
5,348,371 A 9/1994 Miotto
5,383,377 A 1/1995 Boike
5,394,770 A 3/1995 Boike et al.
5,417,474 A 5/1995 Golynsky
5,477,745 A 12/1995 Boike et al.
5,570,612 A 11/1996 Reasoner
5,577,807 A 11/1996 Hodge et al.
5,598,743 A 2/1997 Yasuda
5,605,074 A 2/1997 Hall et al.
5,655,415 A 8/1997 Nagle et al.
5,673,596 A 10/1997 Lu
5,709,132 A 1/1998 Irish et al.
5,765,914 A 6/1998 Britain et al.
5,771,750 A 6/1998 Bell et al.
5,788,328 A 8/1998 Lance
5,823,063 A 10/1998 Nagle et al.
5,911,791 A 6/1999 Srinivas
5,915,788 A 6/1999 Schneider
5,921,143 A 7/1999 Castillo et al.
5,934,150 A 8/1999 Srinivas et al.
5,971,481 A 10/1999 Emmenegger et al.
5,975,634 A 11/1999 Knoblock et al.
5,975,639 A 11/1999 Wilson et al.
5,979,984 A 11/1999 DeKraker et al.
6,003,943 A 12/1999 Schneider
6,033,020 A 3/2000 Ito
6,086,153 A 7/2000 Heidmann et al.
6,116,688 A 9/2000 Wilkerson et al.
6,139,103 A 10/2000 Hybarger et al.
6,213,552 B1 4/2001 Miotto
6,216,555 B1 4/2001 Malone
6,247,380 B1 6/2001 Cebollero
6,250,715 B1 6/2001 Caruso et al.
6,263,756 B1 7/2001 Gabas Cebollero et al.
6,273,506 B1 8/2001 Niergarth et al.
6,361,110 B2 3/2002 Roslund, Jr. et al.
6,378,943 B1 4/2002 Beggs et al.
6,394,548 B1 5/2002 Battey et al.
6,435,056 B2 8/2002 Meyer
6,561,057 B2 5/2003 Cebollero
6,588,843 B1 7/2003 Ebenstein
6,880,886 B2 4/2005 Bodnar et al.
6,932,430 B2 8/2005 Bedford et al.
7,147,285 B2 12/2006 Lin
7,396,081 B2 7/2008 Matern et al.
7,429,081 B2 9/2008 Roslund et al.
7,513,570 B2 4/2009 Roslund et al.
2001/0000939 A1 5/2001 Roslund, Jr. et al.
2001/0040399 A1 11/2001 Caruso et al.
2002/0043845 A1 4/2002 VanDeRiet et al.
2004/0104611 A1 6/2004 Caruso et al.
2004/0155502 A1 8/2004 Johnson et al.
2004/0183350 A1 9/2004 Schmitz et al.
2007/0057553 A1 3/2007 Roslund et al.

TILT CONTROL MECHANISM FOR A CHAIR

CROSS REFERENCE TO RELATED APPLICATION

This application is a continuation of U.S. Ser. No. 12/150,847, filed May 1, 2008, now U.S. Pat. No. 7,513,570 B2, which is a divisional of U.S. Ser. No. 11/598,166, filed Nov. 10, 2006, now U.S. Pat. No. 7,429,081 B2, which is a continuation of PCT Application No. PCT/US06/07820, filed Mar. 1, 2006, which claims the benefit of U.S. Provisional Application Nos. 60/657,541, filed Mar. 1, 2005, and 60/689,723, filed Jun. 10, 2005, all of which are incorporated herein by reference.

FIELD OF THE INVENTION

The invention relates to an office chair and more particularly, to improvements in the tilt control mechanism of the office chair.

BACKGROUND OF THE INVENTION

Conventional office chairs are designed to provide significant levels of comfort and adjustability. Such chairs typically include a base which supports a tilt control assembly to which a seat assembly and back assembly are movably interconnected. The tilt control mechanism includes a back upright which extends rearwardly and upwardly and supports the back assembly rearwardly adjacent to the seat assembly. The tilt control mechanism serves to interconnect the seat and back assemblies so that they may tilt rearwardly together in response to movements by the chair occupant and possibly to permit limited forward tilting of the seat and back. Further, such chairs typically permit the back to also move relative to the seat during such rearward tilting.

To control rearward tilting of the back assembly relative to the seat assembly, the tilt control mechanism interconnects these components and allows such rearward tilting of the back assembly. Conventional tilt control mechanisms include tension mechanisms such as spring assemblies which use coil springs or torsion bars to provide a resistance to pivoting movement of an upright relative to a fixed control body, i.e. tilt tension. The upright supports the back assembly and the resistance provided by the spring assembly thereby varies the load under which the back assembly will recline or tilt rearwardly. Such tilt control mechanisms typically include tension adjustment mechanisms to vary the spring load to accommodate different size occupants of the chair.

Additionally, conventional chairs also may include various mechanisms to control forward tilting of the chair and define a selected location at which rearward tilting is stopped.

Still further, such chairs include a pneumatic cylinder which is enclosed within a base of the chair on which the tilt control mechanism is supported. As such, the pneumatic cylinder is selectively extendable to vary the elevation at which the tilt control mechanism is located to vary the seat height. Such pneumatic cylinders include conventional control valves on the upper ends thereof and it is known to provide pneumatic actuators which control the operation of the valve and thereby allow for controlled adjustment of the height of the seat.

It is an object of the invention to provide an improved tilt control mechanism for such an office chair.

In view of the foregoing, the invention relates to a tilt control mechanism for an office chair having improved stop assemblies for forward tilt and rearward tilt as well as an improved pneumatic actuator for the chair. The front and rear stop assemblies cooperate with an interior control plate that is disposed within the control body and rotates in unison with a control shaft on which the uprights are supported. The front and rear stop assemblies selectively cooperate with this control plate to control forward tilting and rearward tilting of the chair.

Additionally, the pneumatic actuator assembly utilizes relatively rotatable cam blocks wherein rotation of one rotatable block relative to a fixed block causes vertical displacement of the rotatable block to depress the cylinder valve. Thus, the cooperating cam blocks convert horizontal displacement of the rotatable block into a corresponding vertical displacement thereof to actuate the valve. This rotatable block is driven by a conventional cable actuator that is in turn controlled by a flipper handle on the seat assembly.

Further, an improved actuator mechanism is provided for selectively actuating a rear stop assembly as well as a pneumatic cylinder actuator. This actuator assembly includes separate actuator handles for a front and rear stop assembly. The actuator handles are mounted on a common shaft and includes an improved over-center snap lock arrangement for the actuator handles. Still further, an improved cable connector for connecting the opposite end of each actuator cable to a respective bracket on the control housing.

These various mechanisms provide improved control to forward and rearward tilting of the seat and back assemblies and height adjustment thereof. Other objects and purposes of the invention, and variations thereof, will be apparent upon reading the following specification and inspecting the accompanying drawings.

Figure 2:
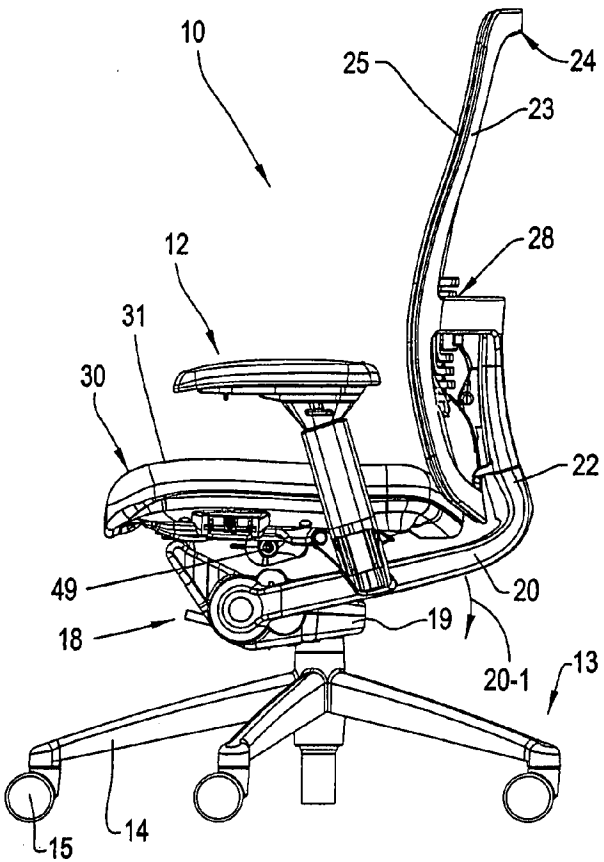
FIG. 2 is a side elevational view thereof.
Figure 1:
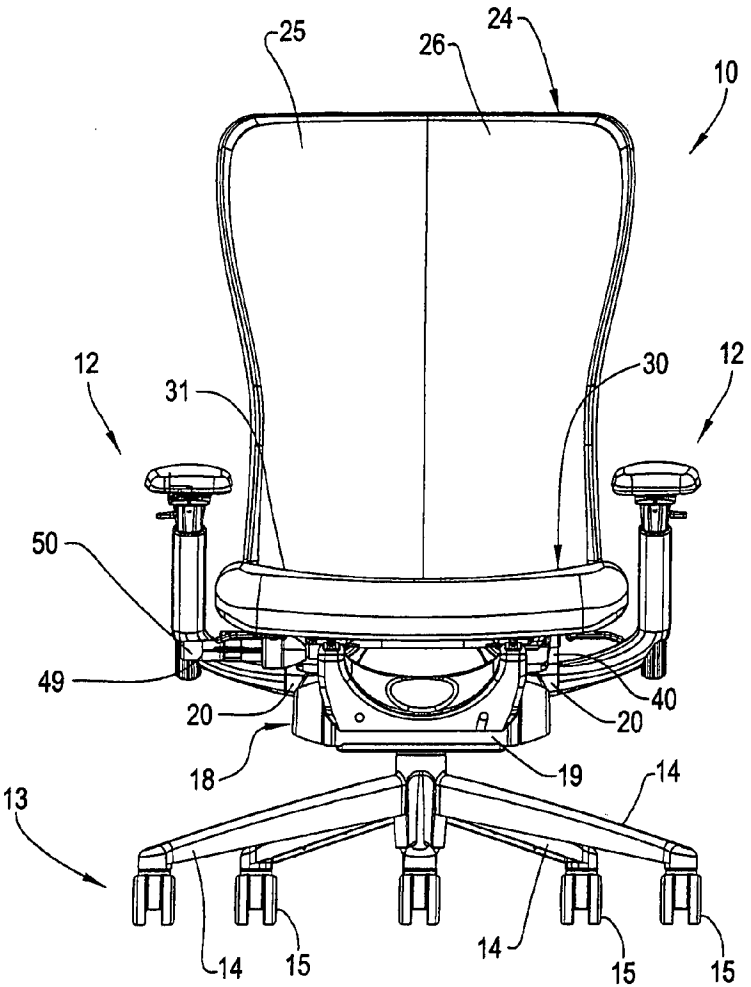
FIG. 1 is a front elevational view of an office chair of the invention.
Figure 4:
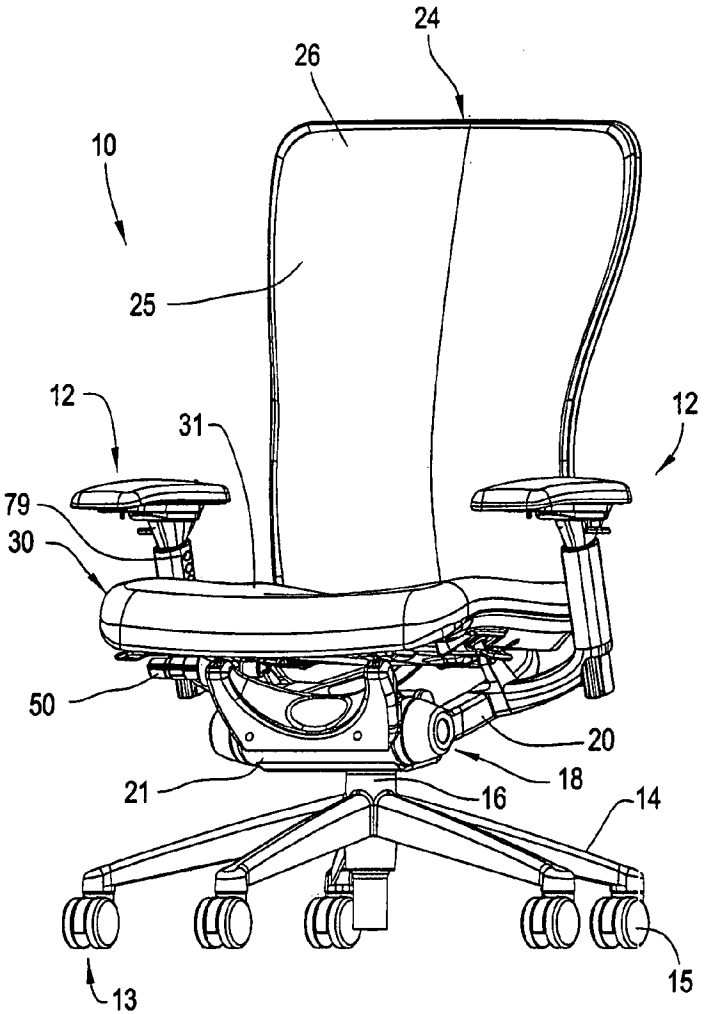
FIG. 4 is a front isometric view thereof.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1-4, the invention generally relates to an office chair 10 which includes various inventive features therein that accommodate the different physical characteristics and comfort preferences of a chair occupant.

Generally, this chair 10 includes improved height-adjustable arm assemblies 12 which are readily adjustable. The structure of each arm assembly 12 is disclosed in U.S. Provisional Patent Application Ser. No. 60/657,632, filed Mar. 1, 2005, entitled ARM ASSEMBLY FOR A CHAIR, which is owned by Haworth, Inc., the common assignee of this present invention. The disclosure of this patent application is incorporated herein in its entirety by reference.

The chair 10 is supported on a base 13 having radiating legs 14 which are supported on the floor by casters 15. The base 13 further includes an upright pedestal 16 which projects vertically and supports a tilt control mechanism 18 on the upper end thereof. The pedestal 16 has a pneumatic cylinder therein which permits adjustment of the height or elevation of the tilt control mechanism 18 relative to a floor.

The tilt control mechanism 18 includes a control body 19 on which a pair of generally L-shaped uprights 20 are pivotally supported by their front ends. The uprights 20 converge rearwardly together to define a connector hub 22 on which is supported the back frame 23 of a back assembly 24. The tension adjustment mechanism for this tilt control mechanism 18 is disclosed in U.S. Patent Application No. 60/657,524, filed Mar. 1, 2005, entitled TENSION ADJUSTMENT MECHANISM FOR A CHAIR, which is owned by Haworth, Inc. The disclosure of this patent application is incorporated herein in its entirety by reference.

The back assembly 24 has a suspension fabric 25 supported about its periphery on the corresponding periphery of the frame 23 to define a suspension surface 26 against which the back of a chair occupant is supported. The back assembly 24 is disclosed in U.S. Patent Application No. 60/657,313, filed Mar. 1, 2005, entitled CHAIR BACK, which is owned by Haworth, Inc. The disclosure of this patent application is incorporated herein in its entirety by reference.

To provide additional support to the occupant, the back assembly 24 also includes a lumbar support assembly 28 which is configured to support the lumbar region of the occupant's back and is adjustable to improve the comfort of this support. The structure of this lumbar support assembly 28 and associated pelvic support structure is disclosed in U.S. Patent Application Ser. No. 60/657,312, filed Mar. 1, 2005, entitled CHAIR BACK WITH LUMBAR AND PELVIC SUPPORTS, which is also owned by Haworth, Inc. The disclosure of this patent application is incorporated herein in its entirety by reference.

Additionally, the chair 10 includes a seat assembly 30 that defines an upward facing support surface 31 on which the seat of the occupant is supported.

Figure 5A:
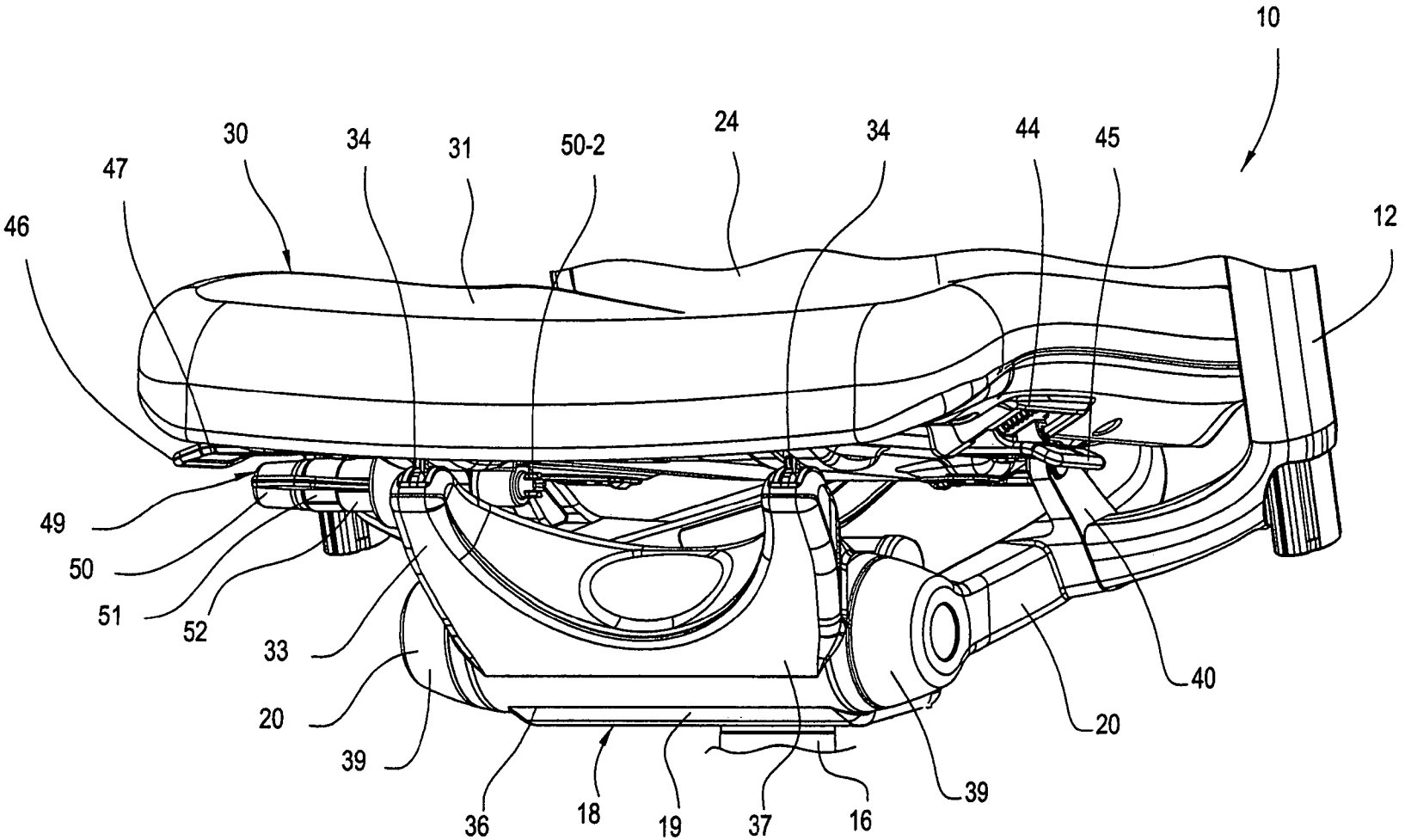
FIG. 5A is a front isometric view of the tilt control mechanism and seat assembly.
Figure 5B:
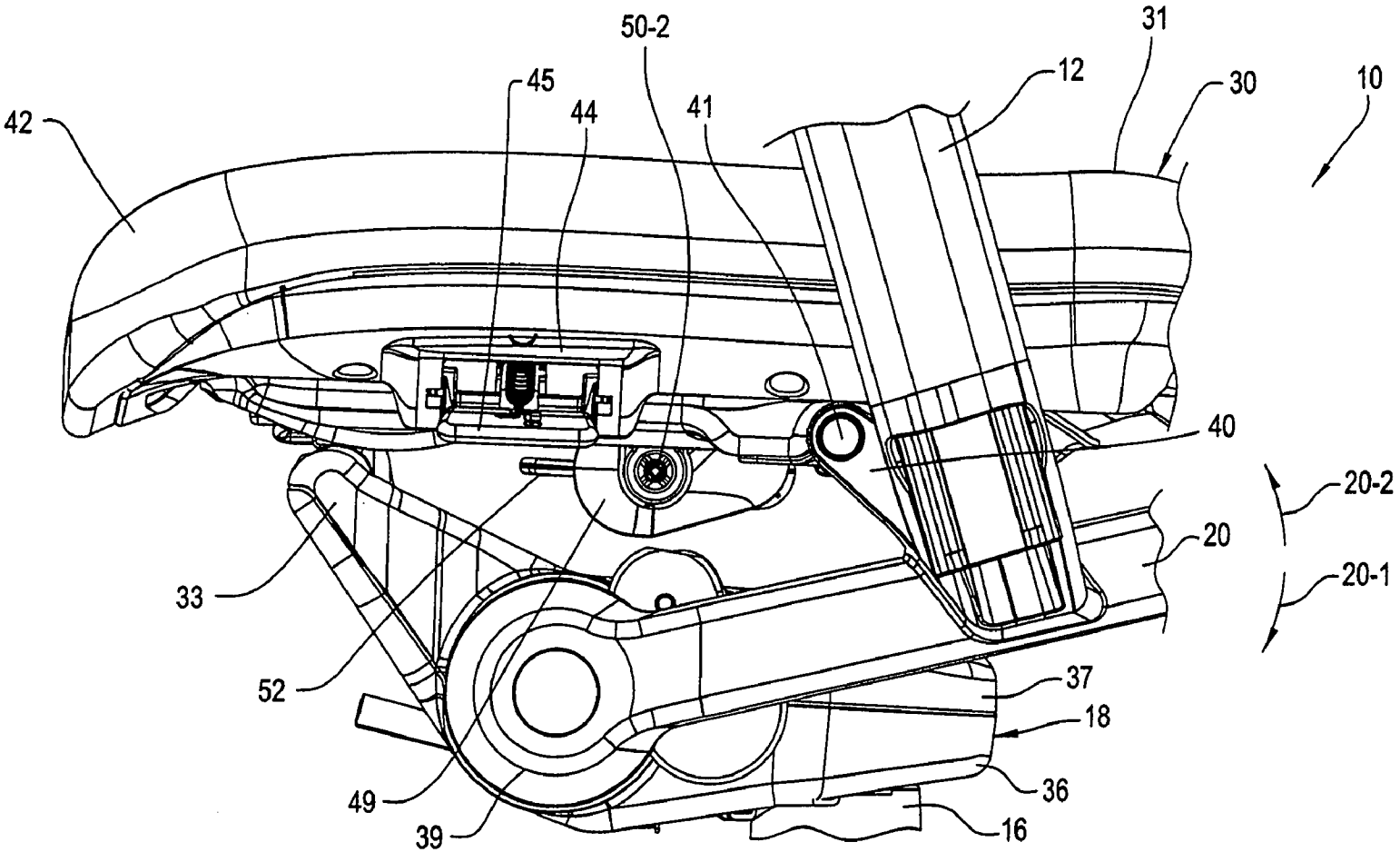
FIG. 5B is an enlarged side view of a tilt control mechanism and seat assembly of the chair.

Referring to FIGS. 5A and 5B, the control body 19 is rigidly supported on the upper end of the pedestal 16 and extends forwardly therefrom to define a pair of cantilevered front support arms 33. Each upper end of the support arms 33 includes a seat retainer 34 which projects upwardly and slidably supports the front end of the seat assembly 30 on the upper ends of the support arms 33.

Figure 6A:
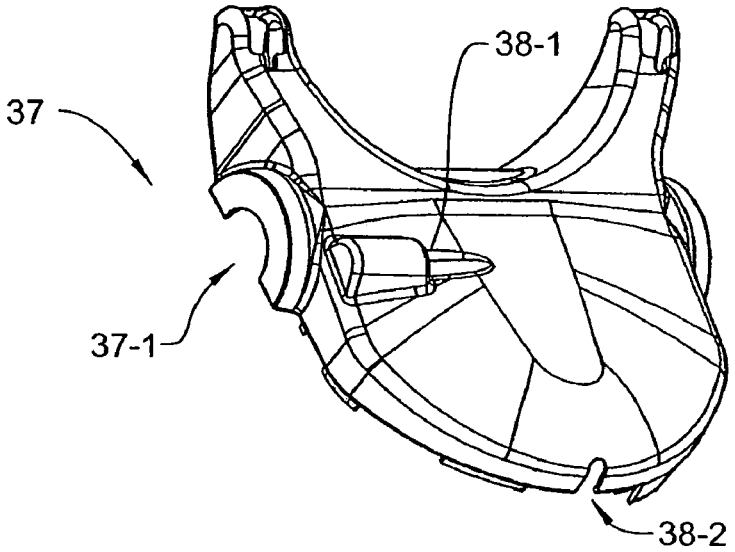
FIG. 6A is an isometric view of an upper cover.
Figure 6B:
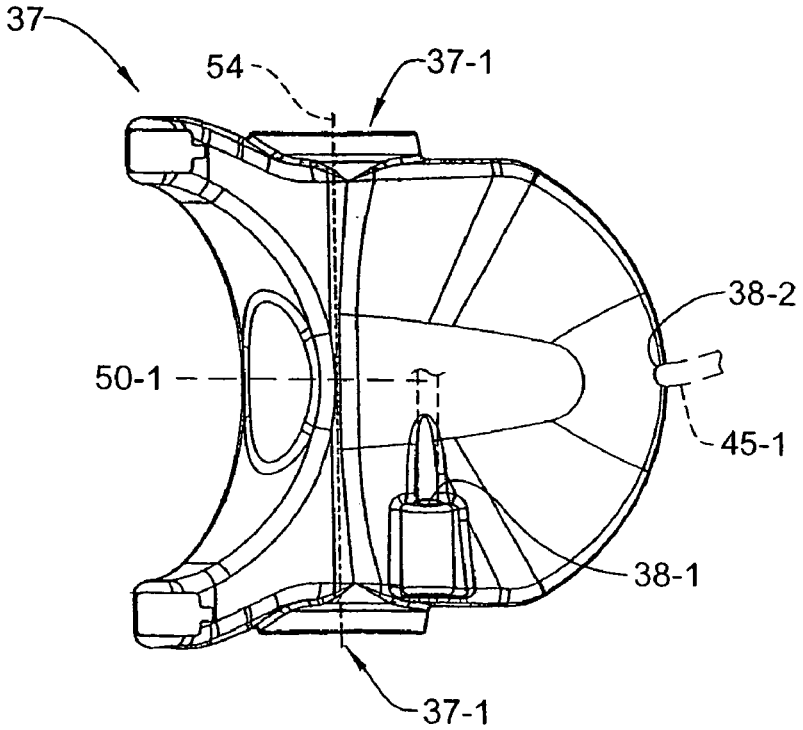
FIG. 6B is a plan view of the upper cover.

The tilt control mechanism 18 further includes a lower cover 36 and an upper cover 37 which are removably engaged with the remaining components of the tilt control mechanism 18. These covers 36 and 37 define the exposed surfaces of the tilt control mechanism 18 and hide the interior components. As seen in FIGS. 6A and 6B, the upper cover 37 includes side openings 37-1 which align with a rotation axis 69 and receive a hex shaft 53 therethrough. The upper cover 37 also includes a bore 38-1 and a cable slot 38-2 in the rear edge thereof.

Figure 3:
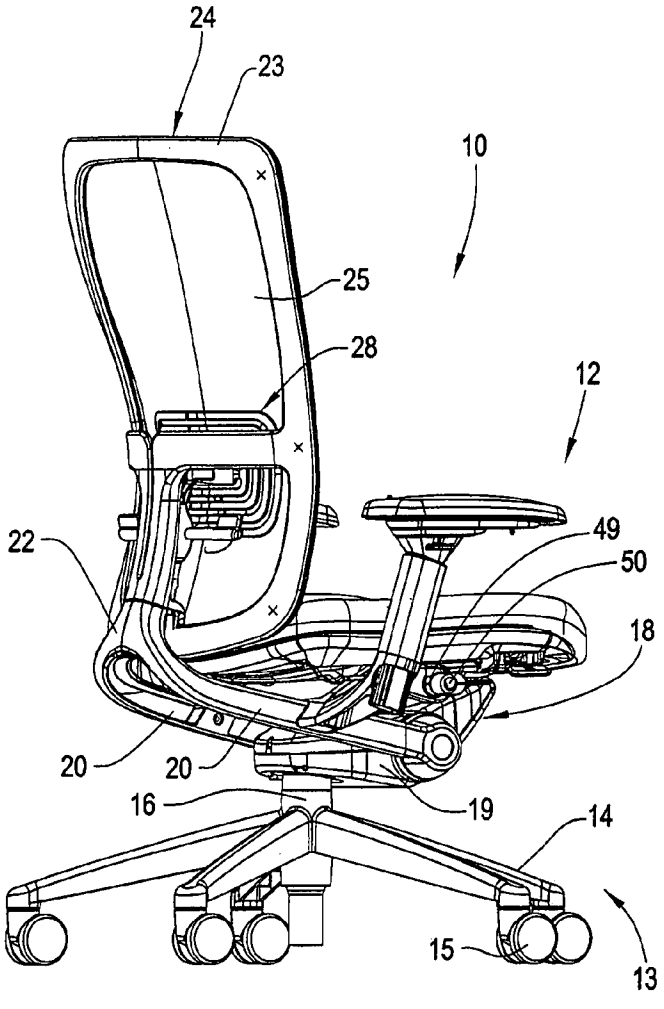
FIG. 3 is a rear isometric view thereof.

Further as to FIGS. 5A and 5B, the uprights 20 are pivotally connected at their front ends 39 to the sides of the tilt control mechanism 19 so as to pivot downwardly in unison. The middle portion of these uprights 20 includes the arm assemblies 12 rigidly affixed thereto, as also illustrated in FIGS. 2 and 3, wherein these uprights 20 define the support hub 22 for supporting the back assembly 24 thereon. As indicated by reference arrow 20-1 in FIG. 5B, the uprights 20 are adapted to pivot clockwise in a downward direction during reclining of the back assembly 24 and also may pivot upwardly (reference arrow 20-2) to a limited extent in the counter clockwise direction to permit forward tilting of the seat assembly 30.

Each upright 20 also includes a seat mount 40 which projects upwardly towards the seat assembly 30 and includes a support shaft 41 that supports the back end of the seat assembly 30. As such, downward pivoting of the uprights 20 causes the back of the seat assembly 30 to be lowered while forward tilting of the chair causes the back of the seat assembly 30 to lift upwardly while the front seat edge 42 pivots about the seat retainers 34 generally in a downward direction. As such, the combination of the tilt control mechanism 18, uprights 20 and seat assembly 30 effectively define a linkage that controls movement of the seat assembly 30 and also effects rearward tilting of the back assembly 24.

In addition to the foregoing, the chair 10 (FIGS. 5A and 5B) further includes various actuators that allow for adjustment of the various components of the seat assembly 30 and tilt control mechanism 18. More particularly, the seat assembly first mounts a lever assembly 44 that has a pivoting lever 45 connected thereto. This pivot lever 45 is connected to an actuator cable 45-1 (FIG. 6B) and serves to control activation of the pneumatic cylinder to permit adjustment of the height of the seat assembly 30 when the lever 45 is lifted.

On the opposite side of the seat assembly, an additional lever assembly 46 is provided which includes a pivotable lever 47. This lever assembly 46 is connected to a sliding seat mechanism in the seat assembly 30 to permit sliding of the seat 30 in a front to rear direction and then lock out sliding when the lever 47 is released.

Also, the chair 10 includes a multi-function clustered handle assembly 49 (FIGS. 5A and 57-62). The outer end of this handle assembly 49 includes a tension adjustment crank 50 (FIGS. 1, 57 and 63) which connects to a flexible adjustment shaft 50-1 (FIG. 6B) at crank connector 50-2 (FIGS. 5A and 63). The adjustment shaft 50-1 cooperates with the tilt control mechanism 19 to adjust the tilt tension generated thereby during rotation of shaft 50-1 by crank 50 as will be discussed in further detail hereinafter.

Also, the handle assembly 49 includes flipper levers 51 and 52 which are each independently movable and may be rotated separate from each other to vary the rear stop and front stop locations defined by the tilt control mechanism 19. The function of this handle assembly 49 will be discussed in further detail hereinafter.

Figure 7:
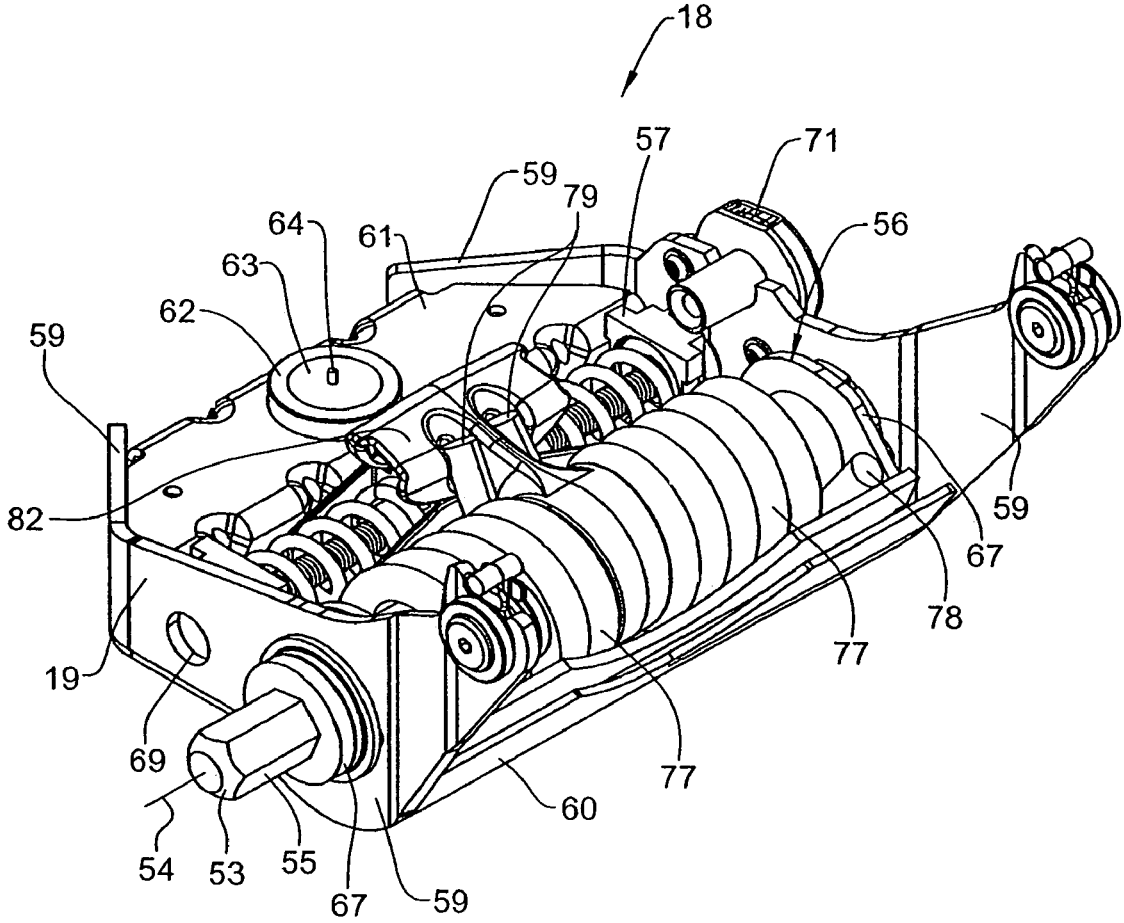
FIG. 7 is a front isometric view of the tilt control mechanism removed from the chair.
Figure 8:
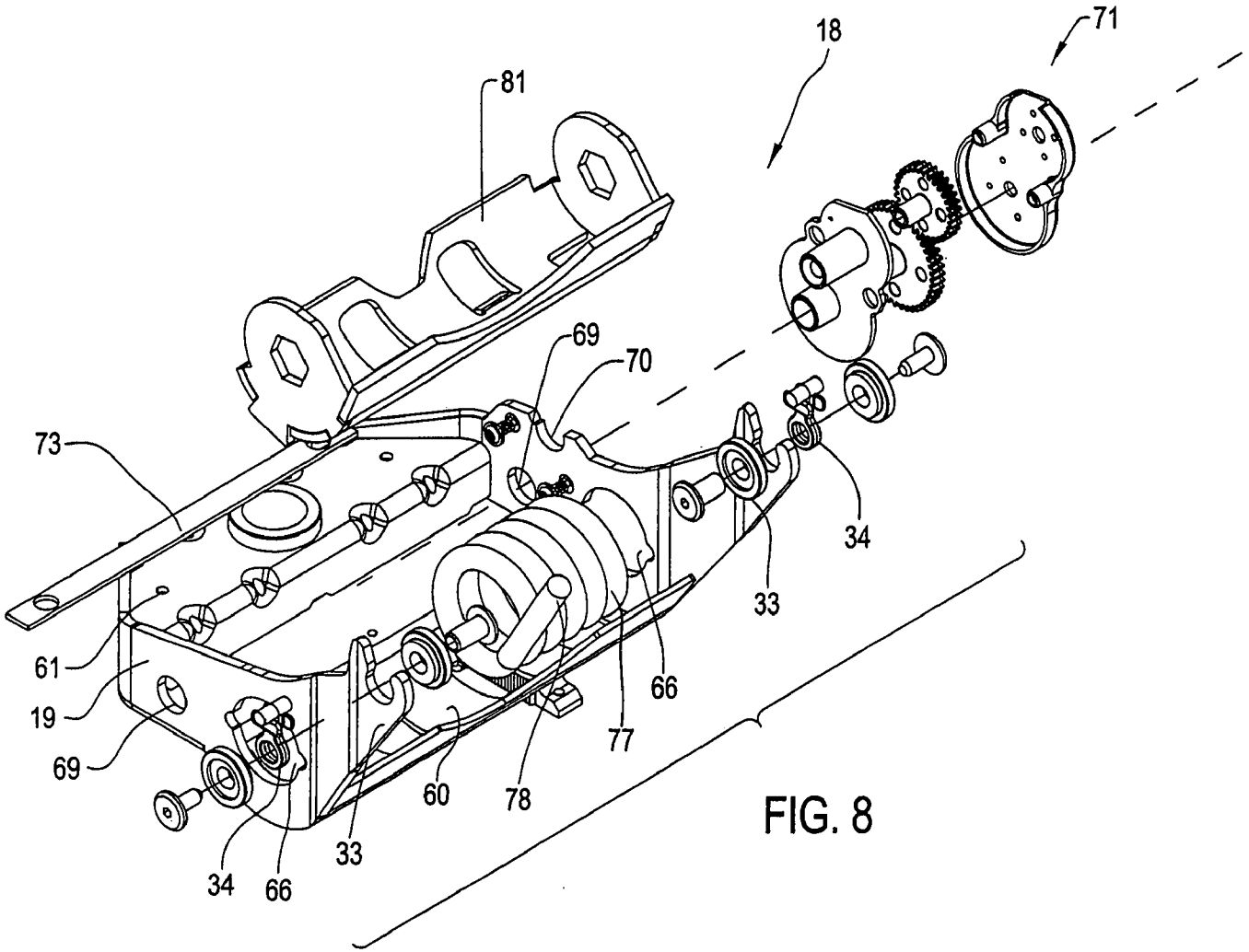
FIG. 8 is an exploded isometric view of the tilt control mechanism.
Figure 9:
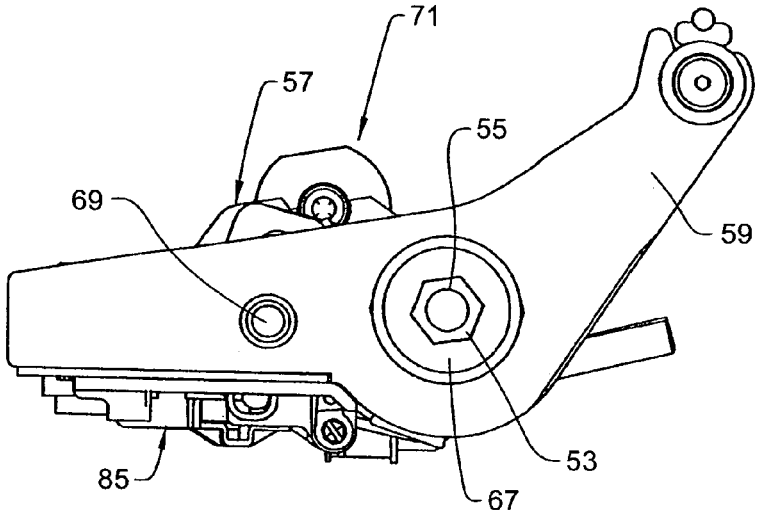
FIG. 9 is a side view thereof.
Figure 10:
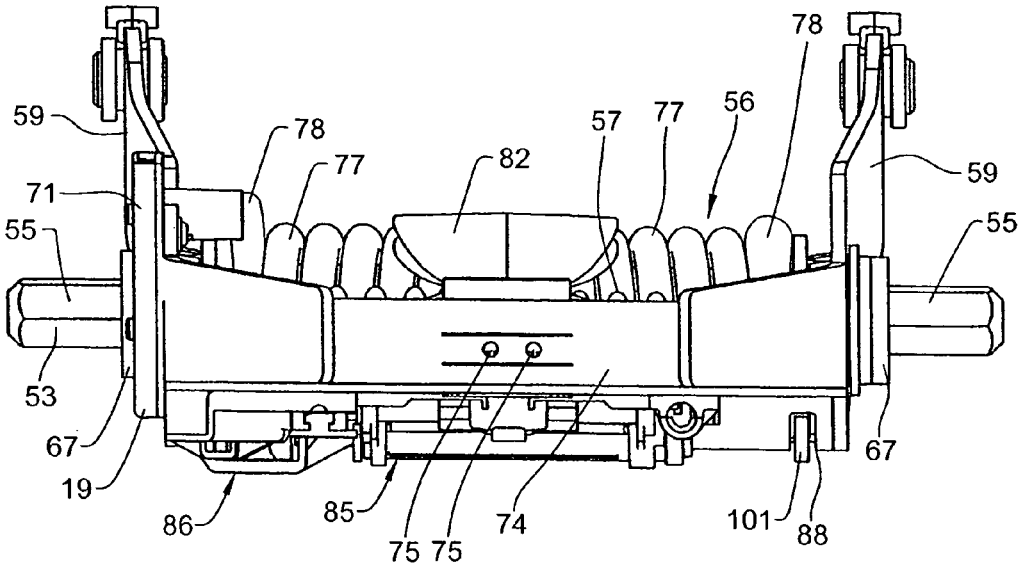
FIG. 10 is a rear view thereof.
Figure 11:
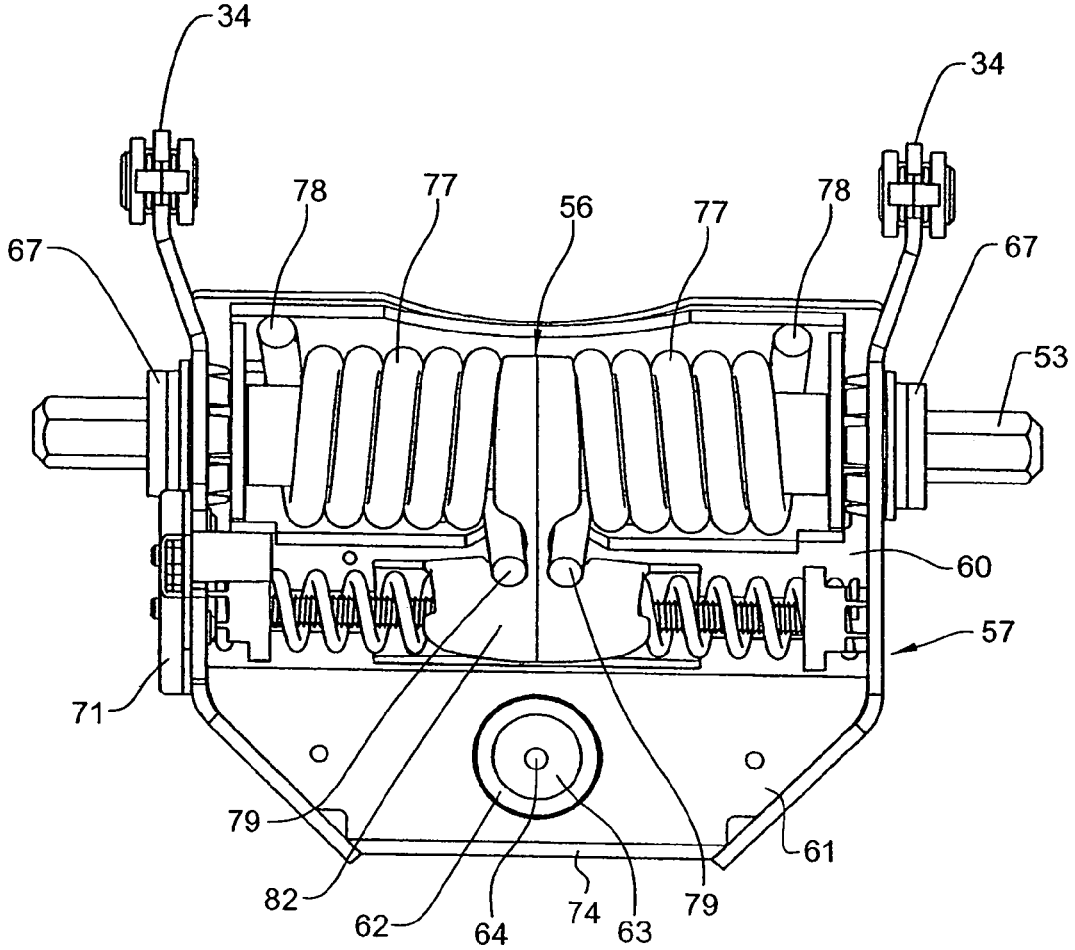
FIG. 11 is a plan view thereof.

Referring to FIGS. 7 and 8, the tilt control mechanism 18 is illustrated with the lower and upper covers 36 and 37 removed therefrom. The tilt control mechanism 18 includes the control body 19 which pivotally supports a hex shaft 53 on which are supported the uprights 20. The uprights 20 connect to the exposed shaft ends 55 and pivot in unison with the hex shaft 53 about a horizontal tilt axis 54 wherein a spring assembly 56 (FIG. 57) is provided to apply tilt tension to the hex shaft 53 which resists rotation of the shaft 53 while still permitting pivoting of the shaft 20 about the tilt axis 54 during tilting of the back assembly 24. To adjust this tilt tension, the spring assembly 56 cooperates with an adjustment assembly 57 that varies the spring load generated by the spring assembly 56 and varies this tilt tension.

Referring more particularly to FIGS. 7-11, the control body 19 is formed as a weldment of steel plates which comprise a pair of side walls 59 that are supported on the control body bottom wall 60. The front ends of the side walls 59 extend upwardly to define the support arms 33, in which the seat retainers 34 are mounted.

The back end of the control body 19 includes a brace section 61 which includes a cylindrical cylinder mount or plug 62 in which is received the upper end of a pneumatic cylinder 63. The upper end of the pneumatic cylinder 63 includes an actuator part formed as a conventional cylinder valve 64 (FIGS. 7 and 11) projecting upwardly therefrom. This cylinder mount 62 is rigidly connected to the upper end of the pedestal 16 so that the tilt control mechanism 18 is rigidly connected to the base 13.

To support the hex shaft 53 and spring assembly 56, the side walls of the control body 19 include a pair of shaft openings 66 (FIG. 8). The shaft openings 66 include a bushing assembly 67 for rotatably supporting the hex shaft 53 therein. Additionally, the side walls 59 each include a further shaft opening 69 to support each end of the adjustment assembly 57 as will be described in further detail hereinafter. Also, a notch 70 is provided just above one of these openings 69 for supporting an upper end of a gear box 71.

Figure 12:
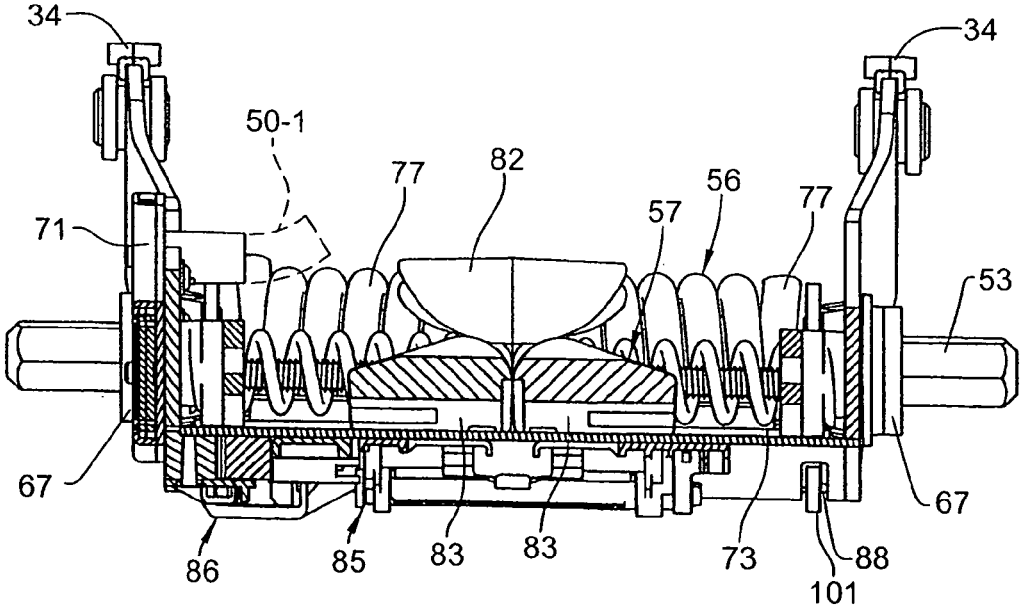
FIG. 12 is a rear cross sectional view thereof.

In the bottom of the control body 19, a rectangular guide rail 73 is mounted therein (FIGS. 8 and 12). Further, the back body wall 74 (FIG. 10) includes a pair of fastener bores 75 to support a mechanism for controlling the pneumatic cylinder valve 64.

More particularly as to the spring assembly 56, this assembly 56 comprises the hex shaft 53 and further includes a pair of coil springs 77 which each include front spring legs 78 and rear spring legs 79. Still further, a control plate or limit bracket 81 is also mounted on the hex shaft 53 so as to rotate therewith. The front spring legs 78 bear against this control plate 81 such that rotation of the hex shaft 53 causes the limit bracket 81 to pivot and deflect the front spring legs 78 relative to the rear spring legs 79. This relative deflection between the spring legs 77 and 78 therefore generates a tilt tension on the hex shaft 53 which resists rearward tilting of the uprights 20 in direction 20-1 (FIG. 5B).

The adjustment assembly 57 acts upon the rear spring legs 79 to deflect the rear spring legs 79 relative to the front spring legs 78 and vary the initial tilt tension which also varies the overall tilt tension generated during rearward tilting of the uprights 20. The adjustment assembly 57 is connected to the gear box 71 which gear box 71 is driven by the adjustment crank 50 referenced above through the associated shaft 50-1 (FIGS. 6B and 12).

Generally, the adjustment assembly 57 includes a cam wedge 82 (FIG. 12) which has the rear spring legs 79 pressing downwardly thereon. The cam wedge 82 therefore is pressed downwardly against a pair of drive blocks 83 which may be selectively moved inwardly toward each other or outwardly away from each other in response to rotation of the shaft 50-1 to effect raising and lowering of the wedge 82 and adjustment of the tilt tension.

Figure 13:
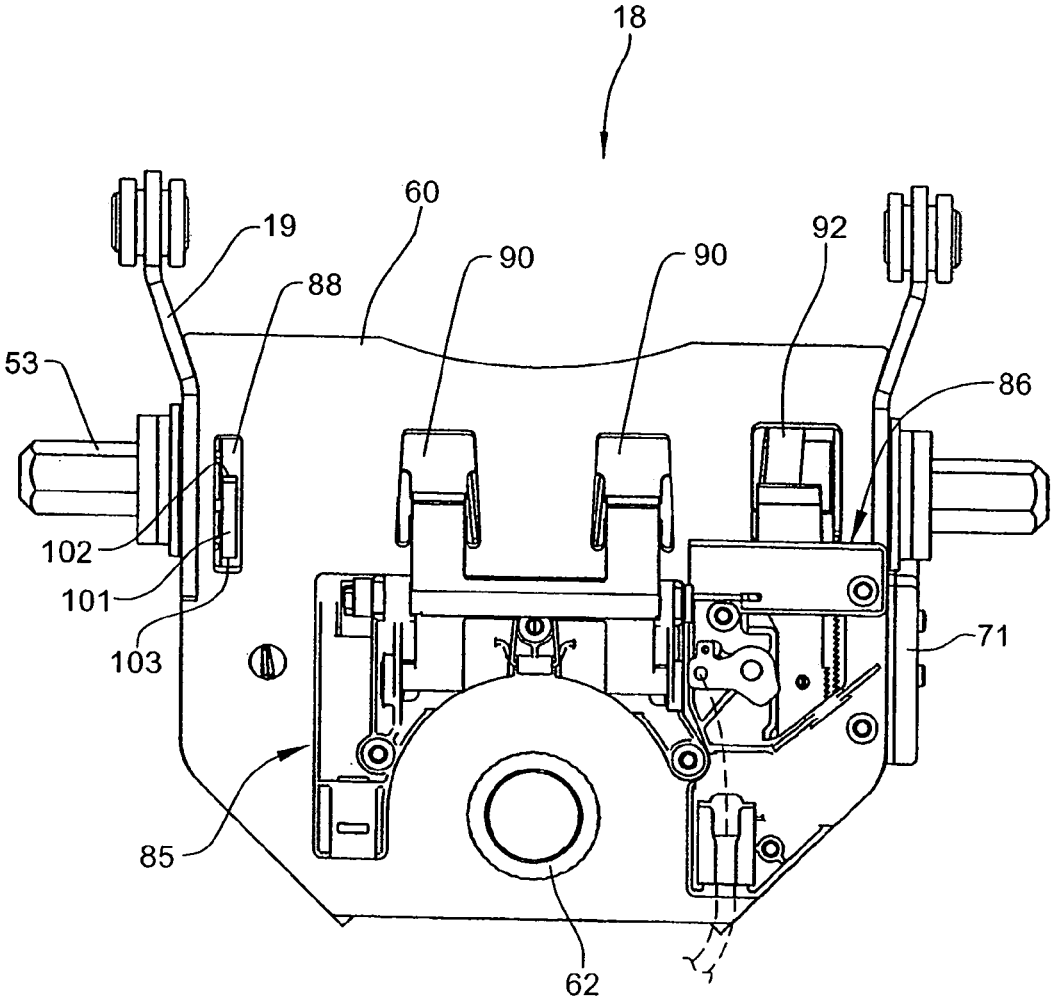
FIG. 13 is a bottom view thereof.
Figure 14:
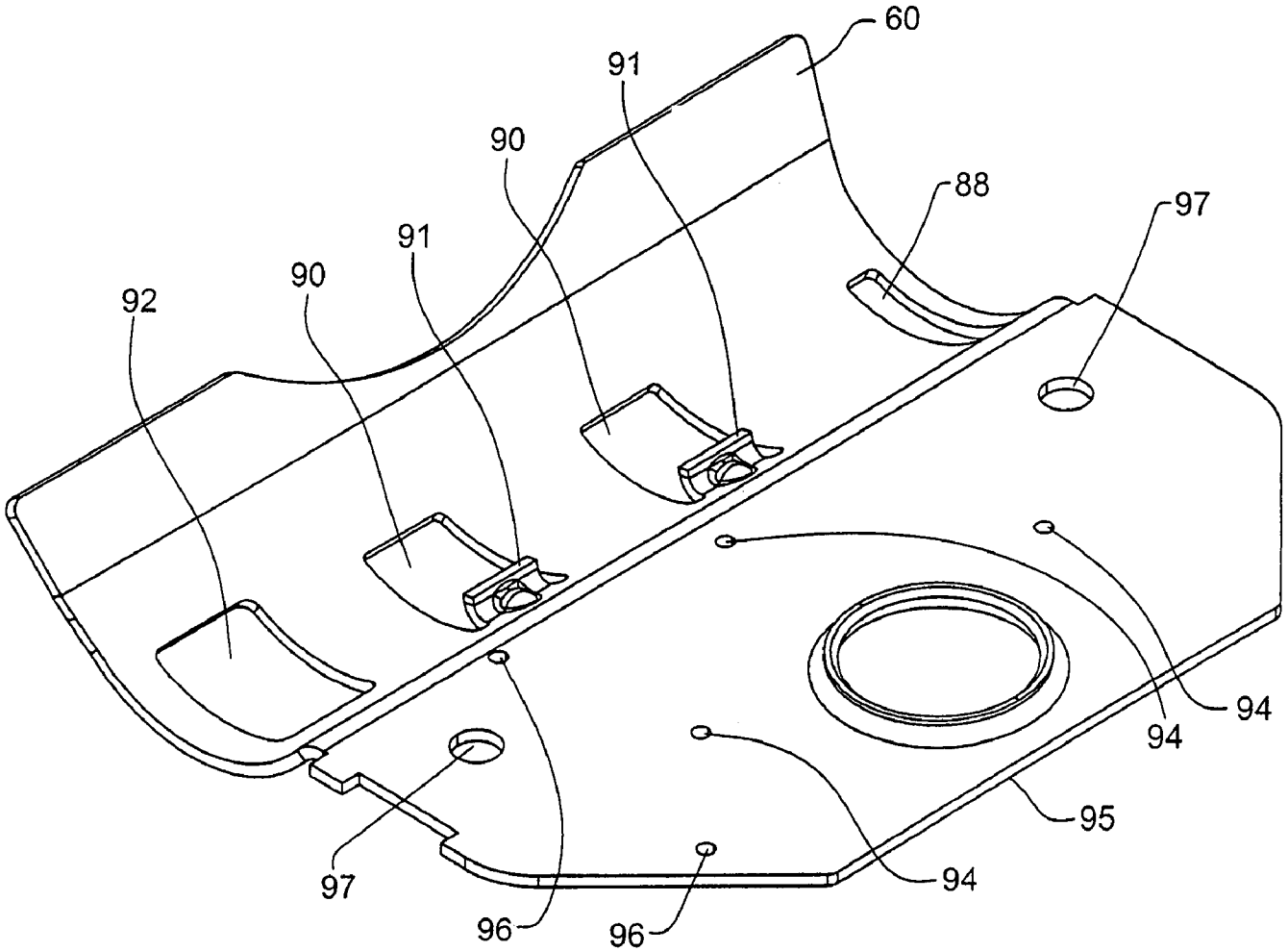
FIG. 14 is an isometric view of a bottom housing plate of the control body.

With the above-described arrangement, the tilt tension being applied to the hex shaft 53 may be readily adjusted by the adjustment crank 50. In addition to this adjustment mechanism 57, the tilt control mechanism 19 also provides for additional mechanisms which serve as front and rear stops that can selectively lock out and control forward tilting and rearward tilting of the uprights 20. Referring to FIG. 13, the bottom of the tilt control mechanism 18 may include a front stop assembly 85 and a rear stop assembly 86 which mount to the bottom of the bottom body wall 60. These stop assemblies 85 and 86 generally cooperate with the limit bracket 81 referenced above that rotates in combination with the hex shaft 53. In this regard, the bottom body wall 60 (FIG. 14) is provided with a plurality of stop openings therein. In particular, a narrow slot 88 is provided which governs the rearmost limit of tilting of the uprights 20 as will be described in further detail. Additionally, a pair of front stop windows 90 are provided in the center portion of the bottom plate 60 and are generally rectangular except that they include upstanding flanges 91 along the rear edge thereof. Lastly, the bottom plate 60 also includes a rear stop window 92.

Figure 18:
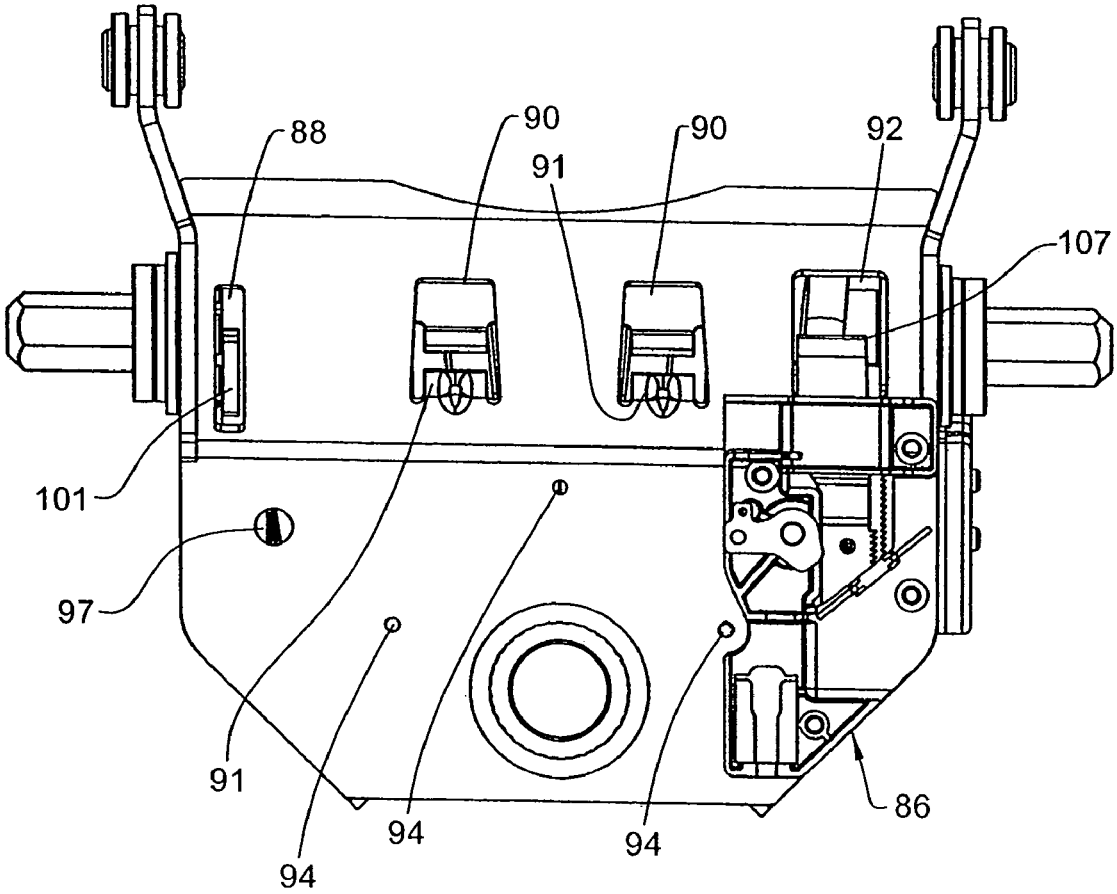
FIG. 18 is a bottom view of the tilt control mechanism with a front stop assembly removed therefrom.

The bottom wall 60 is adapted to secure the front stop assembly 85 and rear stop assembly 86 thereto. Therefore, three fastener bores 94 (FIGS. 14 and 18) are provided for securing the front stop assembly 85 to the bottom wall surface 95. Two additional fastener bores 96 (FIG. 14) are provided to fasten the rear stop assembly 86 also to the bottom wall surface 95. Two additional bores 97 are provided to secure the guide rail 73 to this bottom wall 60.

Figure 15:
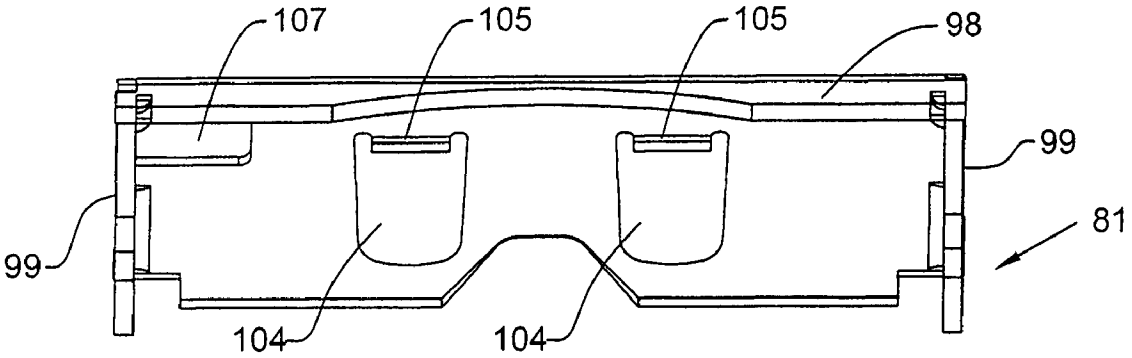
FIG. 15 is a plan view of the control plate.
Figure 17:
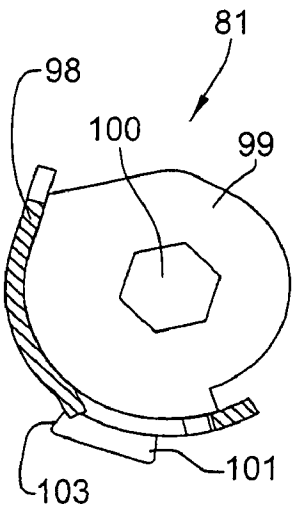
FIG. 17 is a side cross sectional view of the control plate as taken along line 17-17 of FIG. 16.
Figure 16:
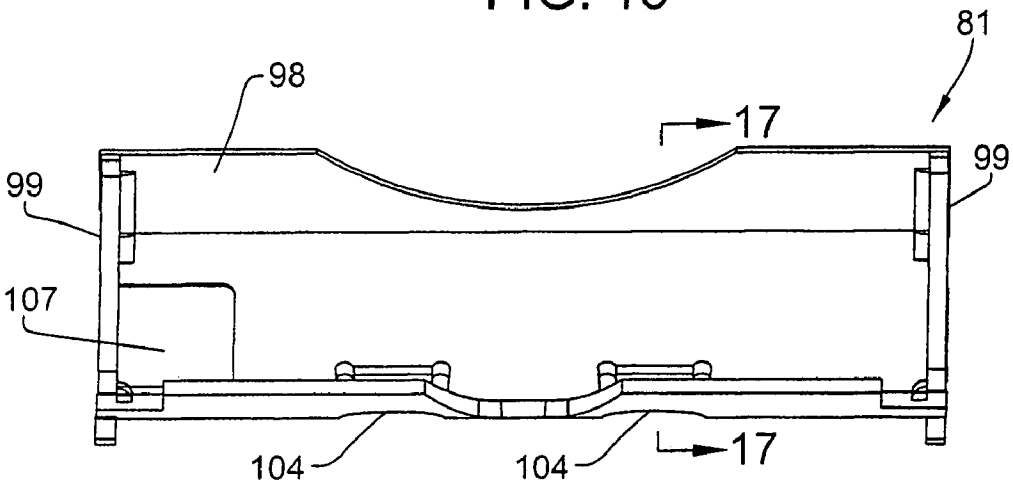
FIG. 16 is a rear view of the control plate.

As generally seen in FIG. 13, the front stop openings 90 align with the front stop mechanism 85 while the rear stop opening 92 aligns with the rear stop mechanism 86. More particularly, these stop mechanisms 85 and 86 communicate through these windows 90 and 92 to engage the limit bracket 81 which rotates over these openings during pivoting of the hex shaft 53. The limit bracket 81 is illustrated in FIGS. 15-17 as having a semi-circular main wall 98 which is enclosed at its opposite ends by side walls 99. Each side wall 99 includes a hex shaft opening 100 through which the hex shaft 53 is non-rotatably received. This hexagonal shaft opening 100 conforms to the shape of the hex shaft 53 such that this limit bracket 81 pivots in unison therewith.

To define the total range of motion for the uprights 90, one of these side walls 99 includes a stop flange 101 projecting radially therefrom that has opposite ends 102 and 103 which are circumferentially spaced apart. This limit flange 101 projects through the corresponding slot 88 formed in the bottom body wall 60 as seen in FIG. 13. The first flange end 102 is adapted to abut against the front edge of the slot 88 during rearward tilting to define the farthestmost limit of rearward tilting.

In addition to the limit flange 101, the limit bracket 81 is formed with a pair of front stop openings 104 which include edge flanges 105 that rigidify this edge so that it may abut against the front stop mechanism 85 and will undergo increased loads as a result thereof. The front plate wall 98 further includes a rear stop opening 107 that aligns with the rear stop window 92 in the bottom body wall 60. This rear stop opening 107 cooperates with the rear stop mechanism 86 such that the user may define any desired rear stop position for the chair.

Figure 20:
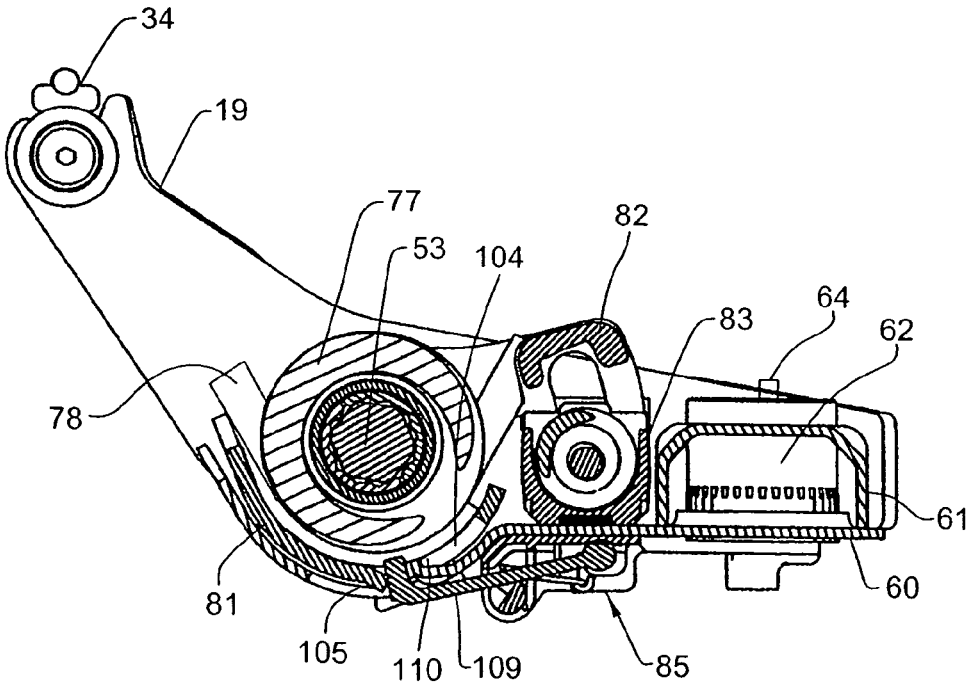
FIG. 20 is a side cross sectional view of the tilt control mechanism as taken through the front stop assembly.

Generally as to the front stop assembly 85, this assembly 85 includes a pivoting stop lever 109 which has an upwardly projecting stop finger 110 which inserts through the front stop window 90 in the housing body 60 and upwardly into the aligned front stop opening 104 in the control plate 81. This stop finger 110 is adapted to contact and abut against the corresponding edge flange 105 of the front stop opening 104 so as to prevent forward tilting of the uprights 20 past this position as seen in FIG. 20. However, this front stop opening 104 is circumferentially elongate (FIG. 20) and thus, still permits rearward tilting of the uprights 20. The rear stop assembly 86 generally operates similar to the front stop assembly 85.

Figure 21:
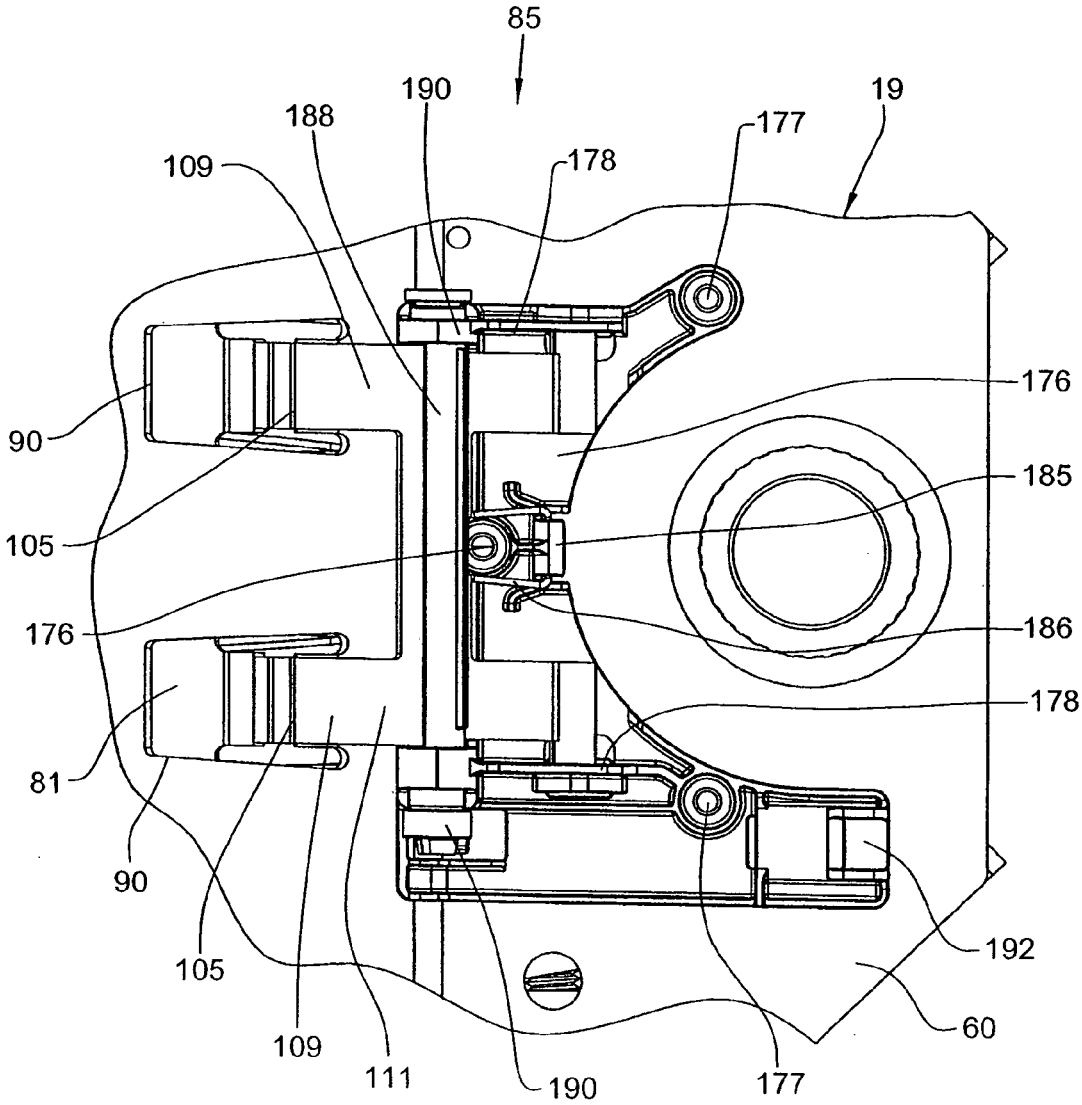
FIG. 21 is an enlarged view of the front stop assembly.
Figure 22:
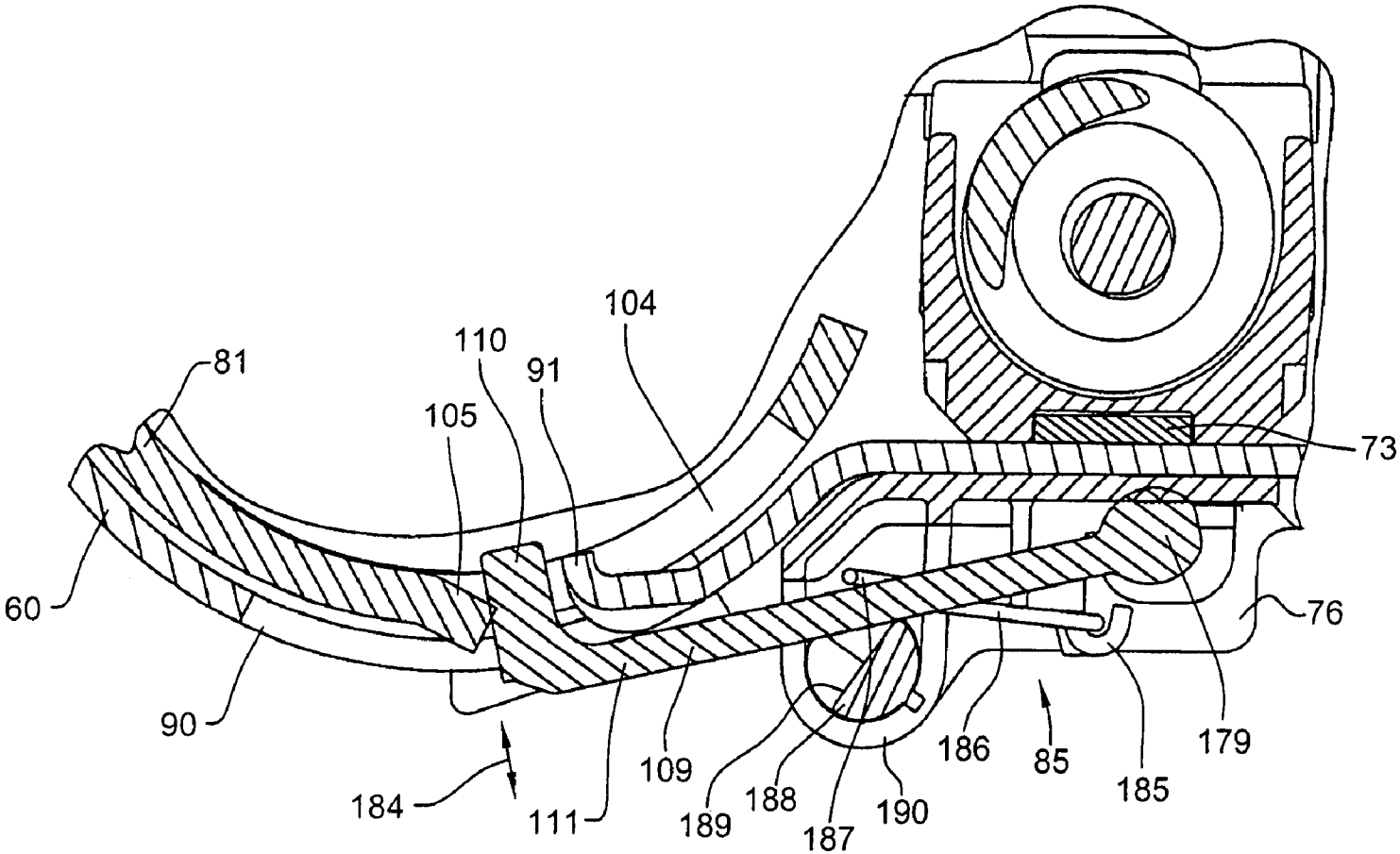
FIG. 22 is a side cross sectional view of the front stop mechanism.
Figure 24:
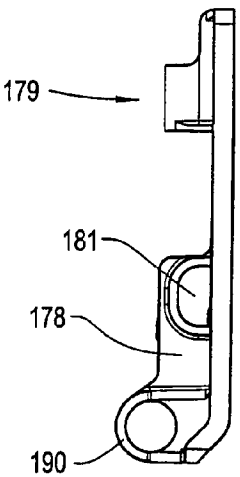
FIG. 24 is a side view thereof.
Figure 25:
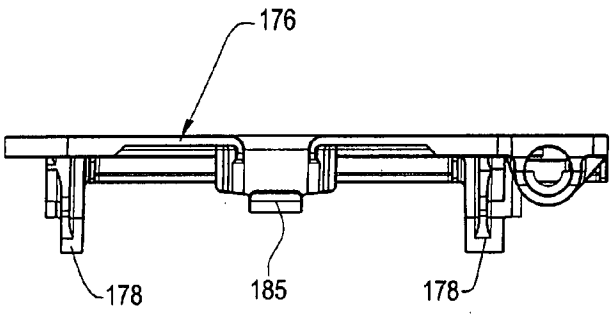
FIG. 25 is a rear view thereof.
Figure 23:
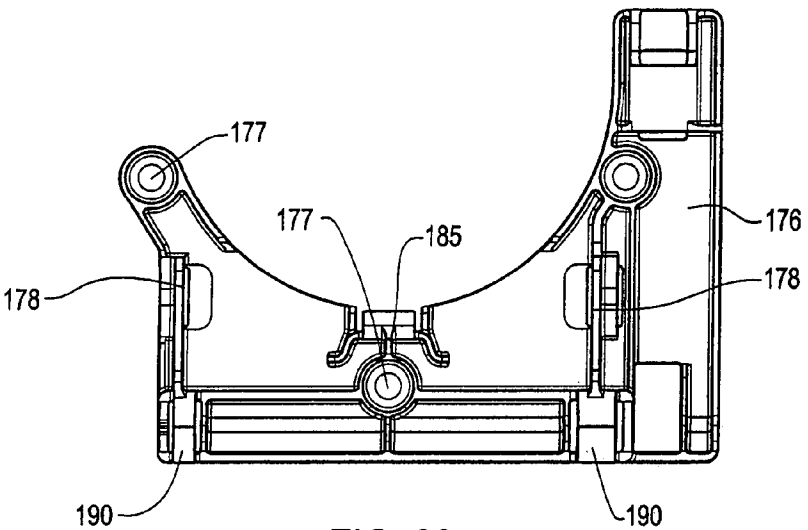
FIG. 23 is a bottom view of the case for supporting the front tilt stop mechanism.

Turning to the front stop assembly 85 of FIGS. 21-22, this mechanism 85 is adapted to engage the front stop openings 104 of the limit bracket 81 through the corresponding windows 90 that are formed in the bottom housing wall 60. Generally, this front stop mechanism 85 includes the pivoting stop lever 109 which includes the arms 111 on which the stop fingers 110 are defined. The stop fingers 110 project radially inwardly into engagement with the limit bracket 81 as will be described in further detail herein.

Figure 26:
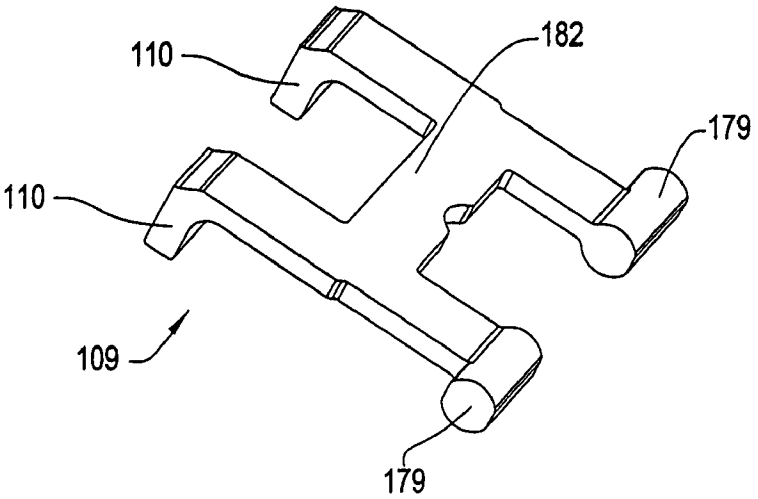
FIG. 26 is an isometric view of a forward tilt lock lever.
Figure 27:
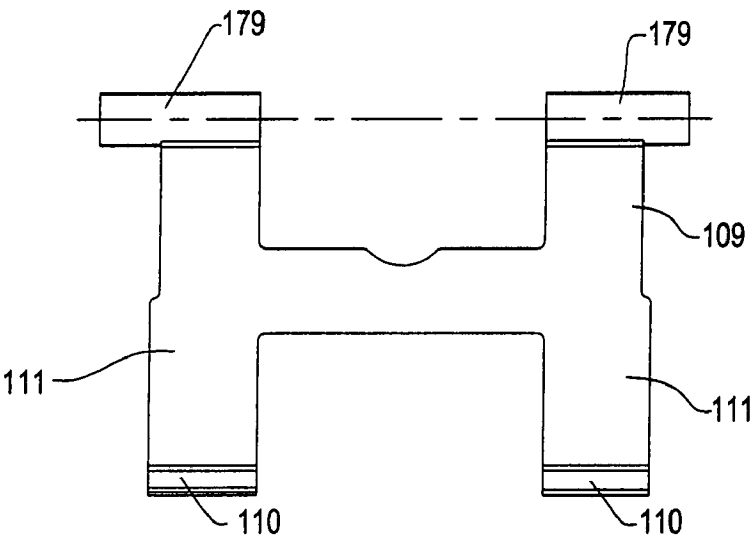
FIG. 27 is a plan view thereof.

Referring to FIGS. 21-25, the front stop assembly 85 includes a mounting bracket 176 that includes fastener holes 177 through which fasteners 177A (FIG. 52) are engaged with the corresponding fastener bores 94 on the bottom body wall 60. The mounting bracket 176 also includes a pair of upstanding pivot flanges 178 which pivotally support the front stop lever 109 (FIGS. 26 and 27). In particular, the front stop lever 109 as illustrated in FIGS. 26 and 27 includes pivot pins 179 which project sidewardly and are rotatably received within corresponding pivot holes 181 (FIG. 24) formed in the mounting bracket 176. Further, the stop lever 109 has a center section 182 which joins the lever arms 111 together. The free ends of the lever arms 111 include the stop fingers 110 projecting upwardly therefrom. When mounted within the bracket 176, the lever 109 is able to pivot upwardly and downwardly as generally indicated by reference arrow 184 of FIG. 22.

Normally, the lever 109 is biased downwardly out of the respective plate openings 90 and 104. In this regard, the bracket 176 includes a spring mount 185. A resilient wire spring 186 is supported on this spring mount 185 and includes a spring leg 187 which normally biases the lever 109 downwardly as illustrated in FIGS. 21 and 22. To actuate the lever 109, an additional control pin 188 is provided that has a semi-circular shape defined by a recessed side portion 189 as seen in FIG. 22. The opposite ends of this actuator pin 188 are supported in a pair of support flanges 190. Since the actuator pin 188 is rotatable, the recessed side portion 189, when disposed adjacent to the lever 109, permits the lever 109 to be displaced outwardly to a disengaged position wherein the stop fingers 110 are displaced outwardly out of the bracket opening 104. However, when the actuator pin 188 is rotated as generally seen in FIG. 22, this displaces the lever 109 upwardly to the engaged position (FIG. 22) wherein the stop finger 110 is disposed within this front stop opening 104. Since the edge flange 105 of this opening now abuts or interferes with the stop finger 110, this stop finger 110 effectively prevents over-tilting of the chair 10.

Figure 19:
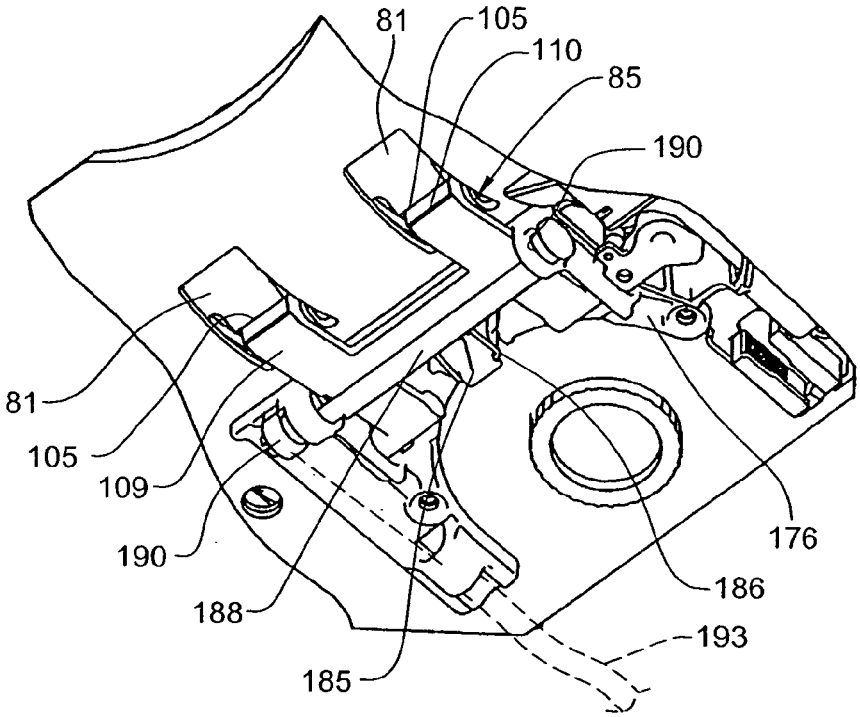
FIG. 19 is a bottom isometric view of the front stop mechanism.

To control rotation of the actuator pin 188, the mounting bracket 176 includes a cable connector 192 that interconnects to an actuator cable 193 (FIG. 19). This actuator cable 193 connects to one of the flipper levers 51 or 52 to either engage the lever 109 or disengage the lever 109 depending upon the direction in which the flipper lever is rotated.

When the lever 109 is disengaged, the flange 105 abuts against the corresponding flange 91 to define the frontmost stop position. When the lever fingers 110 are inserted, these flanges 105 and 91 are spaced apart as seen in FIG. 22 which translates into the extent of forward tilting of the front edge of the seat assembly 30. When so engaged, the chair 10 is maintained in its nominal position.

Figure 52:
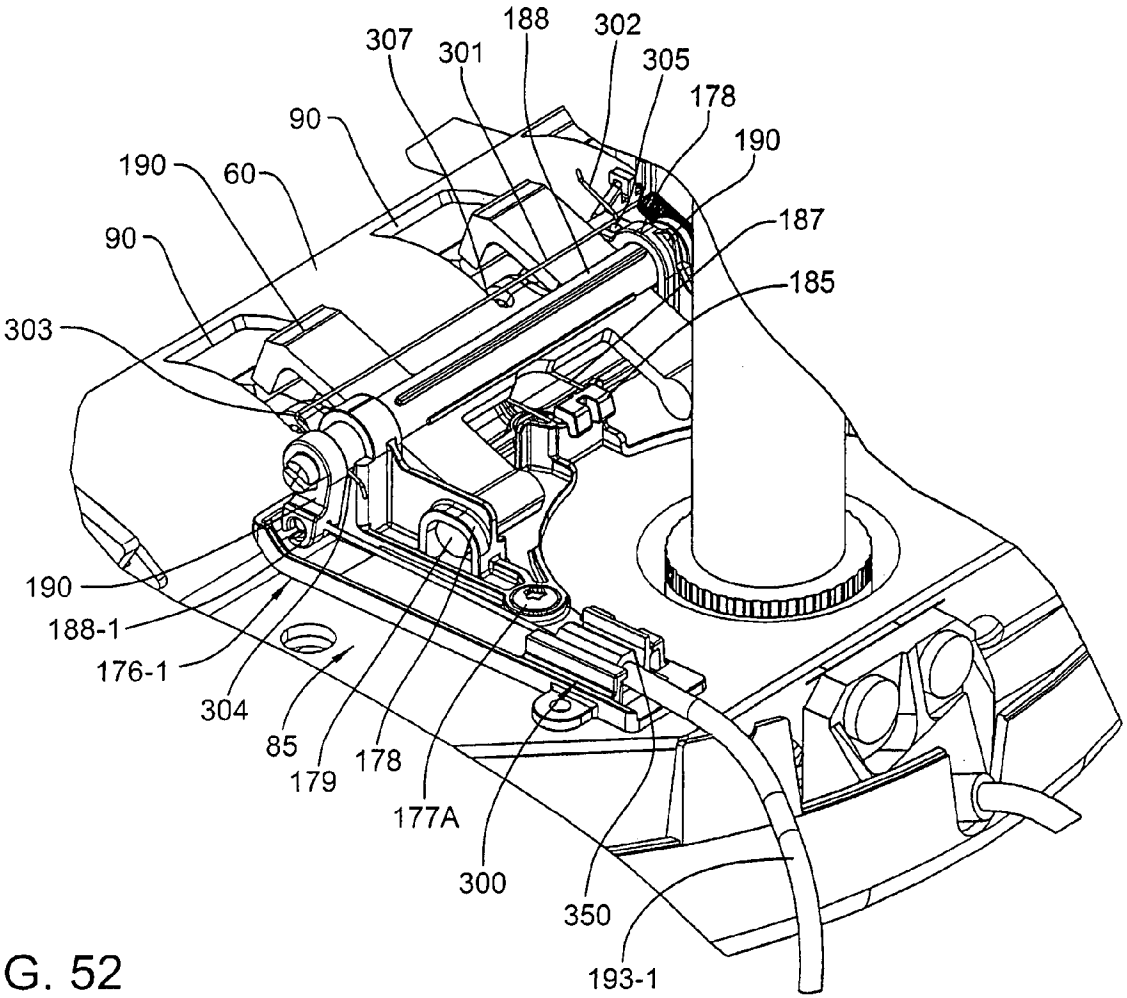
FIG. 52 is an enlarged perspective view illustrating the front stop mechanism with the cable connector arrangement.

Referring to FIG. 52, an improved mounting bracket 176-1 is illustrated which functions substantially the same as that described above except that it includes an improved cable connector mount 300 for a cable connector which will be described in further detail hereinafter relative to FIGS. 53A-56. As to the improved mounting bracket 176-1, this bracket 176-1 is formed substantially the same as bracket 176 described above in that it includes common component parts. In particular, the mounting bracket 176-1 includes pivot flanges 178 that support the lever pivot pins 179. The bracket 176-1 also includes the spring mount 185 which supports the spring leg 187 for the lever 109.

The control pin 188 further is supported in the bracket by the support flanges 190, and one end of the pin 188 includes a radial cable arm 188-1 which is engaged by the actuator cable 193-1 wherein pulling or rotation of the arm 188-1 effects rotation of the pin 188. To provide a restoring torque to the pin 188, an additional torsion spring 301 is provided that includes radial spring legs 302 and 303 at the opposite ends thereof. The radial spring leg 303 extends radially inwardly and passes through a bore 304 in the pin 188. The opposite leg 302 projects generally circumferentially into an additional stationary bore 305. The leg 302 is shown out of this bore 305 in an untwisted condition but it will be understood that this leg 302 is rotated circumferentially so as to twist the intermediate length 307 of the spring 301 and then is inserted in the bore 305 to generate a restoring torque in the spring 301. Thus, as the pin lever 188-1 is rotated, this twists the spring 301 further which resists this rotation of the pin 188 and restores the pin 188 when the actuator cable 193-1 is released.

Figure 29:
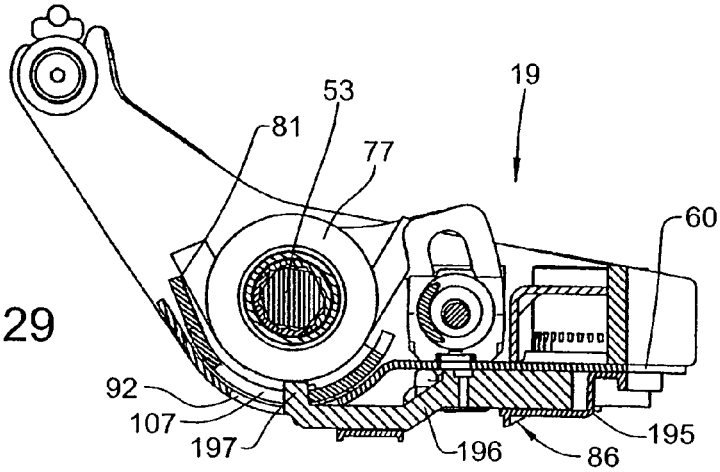
FIG. 29 is a side cross sectional view of the tilt control mechanism as taken through the back stop assembly.
Figure 28:
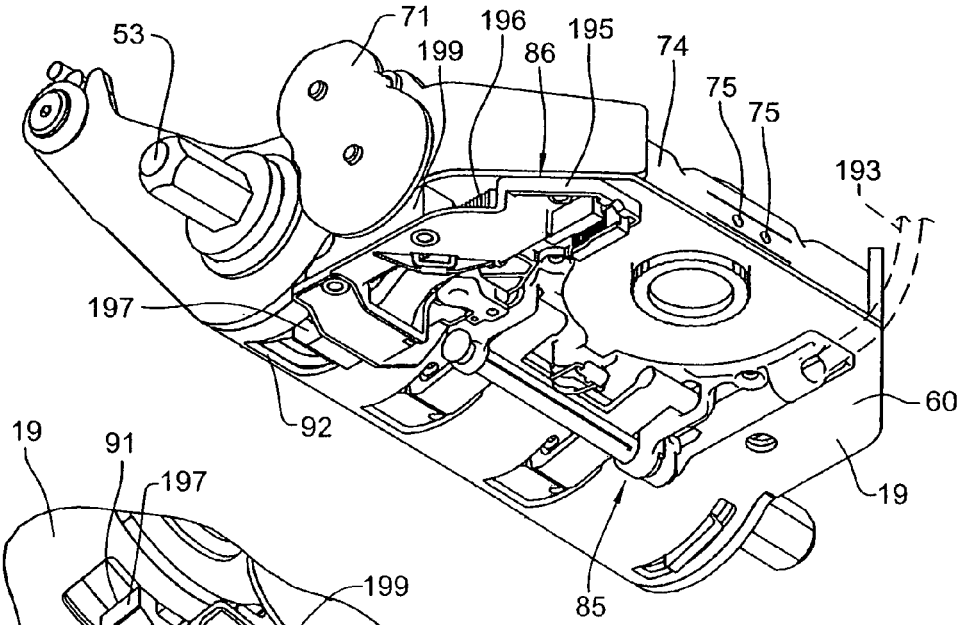
FIG. 28 is a bottom isometric view of the tilt control mechanism.
Figure 30:
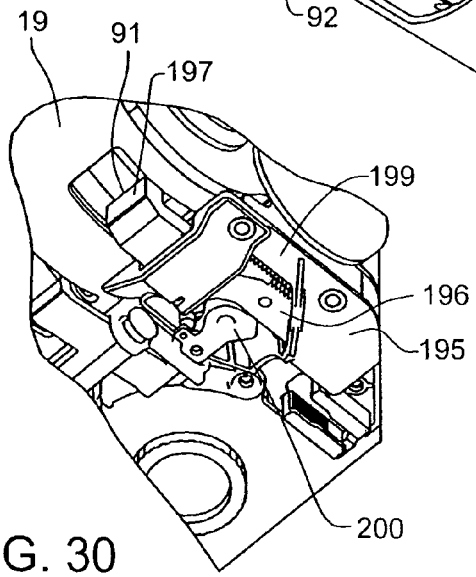
FIG. 30 is an enlarged bottom isometric view of the back stop assembly.

Referring to FIGS. 28-30, the rear stop assembly 86 is provided which also mounts to the bottom of the control body 19. This mechanism 86 includes a cover 195 which mounts to the control body 19 and slidably supports a rear stop arm 196. The stop arm 196 includes a stop finger 197 which projects upwardly into the corresponding opening 107 of the limit bracket 81 through the window 92 formed in the bottom body wall 60. This slidable arm 196 is adapted to lockingly engage a lock block 199 to selectively restrain sliding movement of the slide arm 196. The rear stop assembly 86 also includes an actuator cam 200 to selectively engage and disengage the side stop arm 196 with the lock block 199 as will be described in further detail herein.

Figure 31:
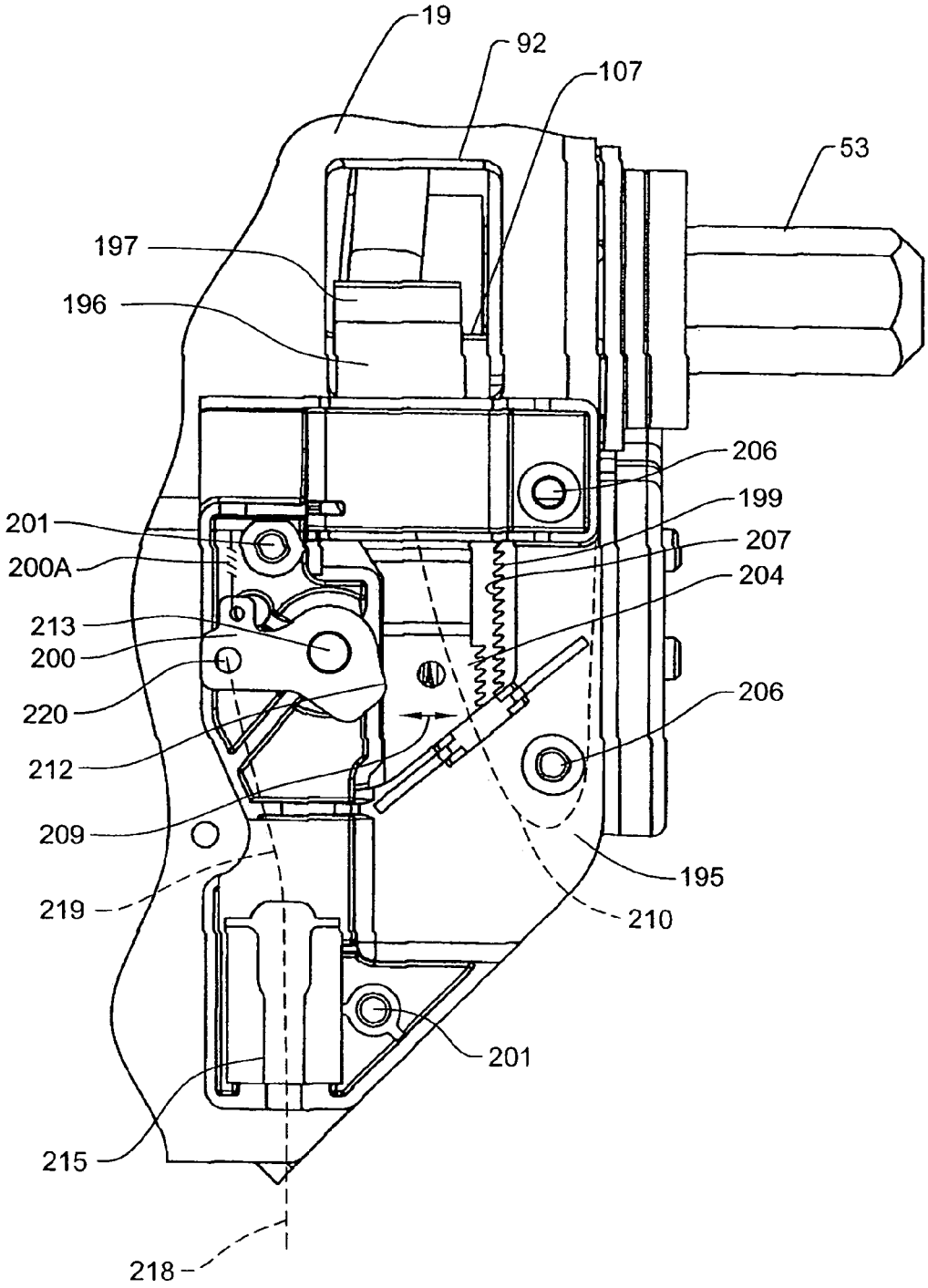
FIG. 31 is a bottom view of the back stop assembly.
Figure 32:
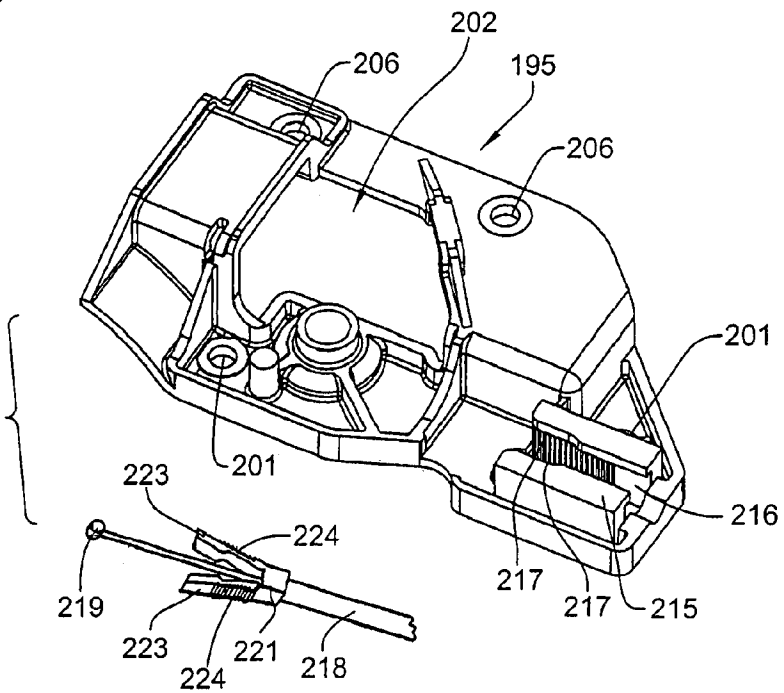
FIG. 32 is an isometric view of the housing for the back stop assembly.
Figure 33:
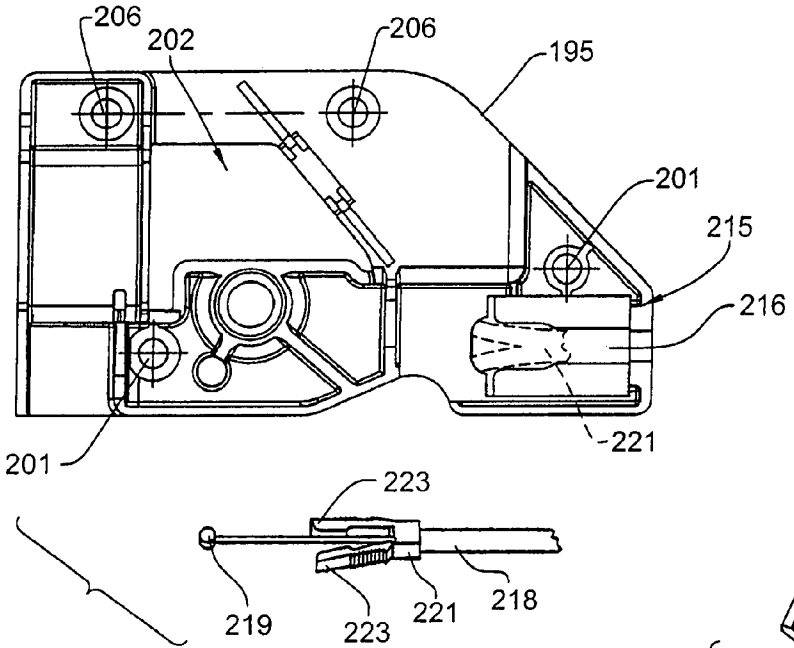
FIG. 33 is a bottom view thereof.
Figure 34:
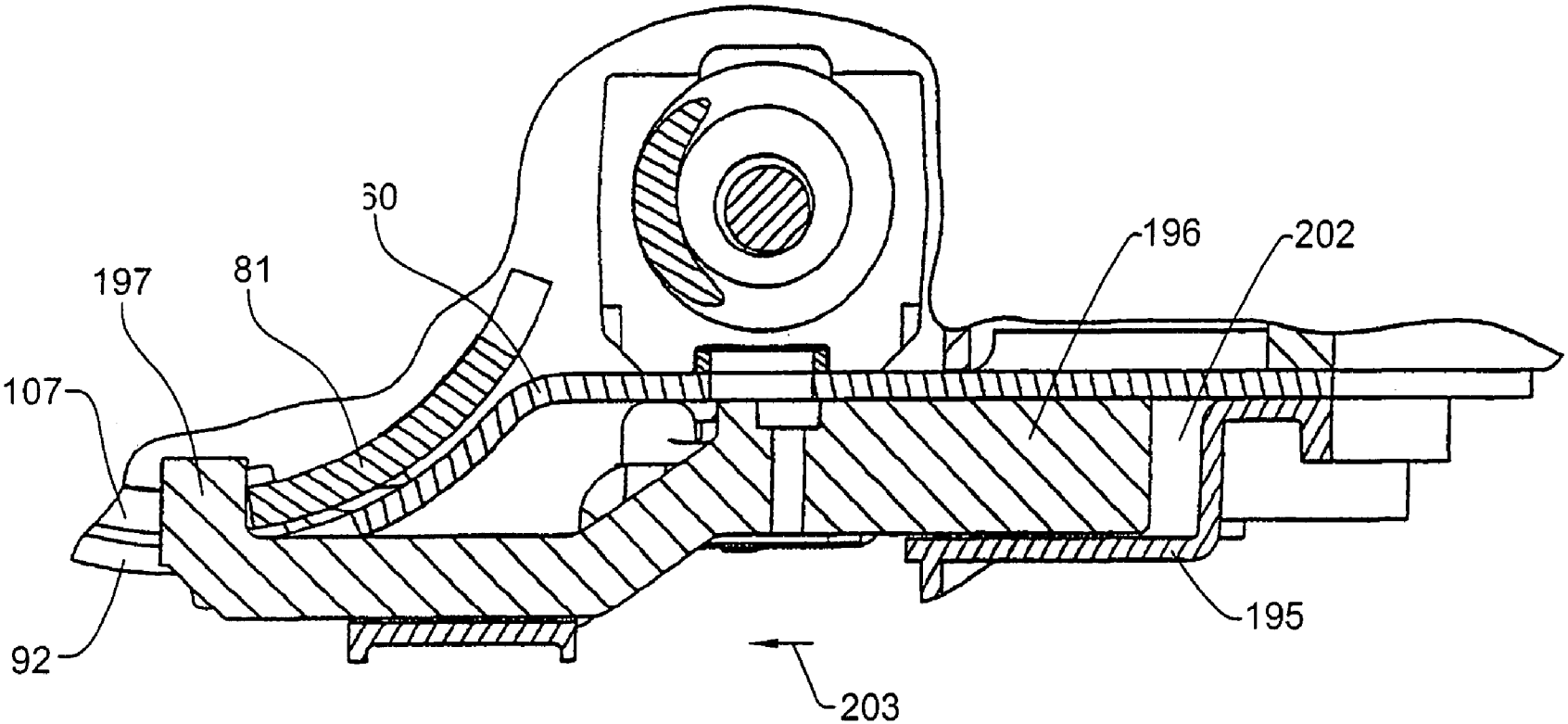
FIG. 34 is an enlarged side cross sectional view of the back stop assembly.
Figure 51:
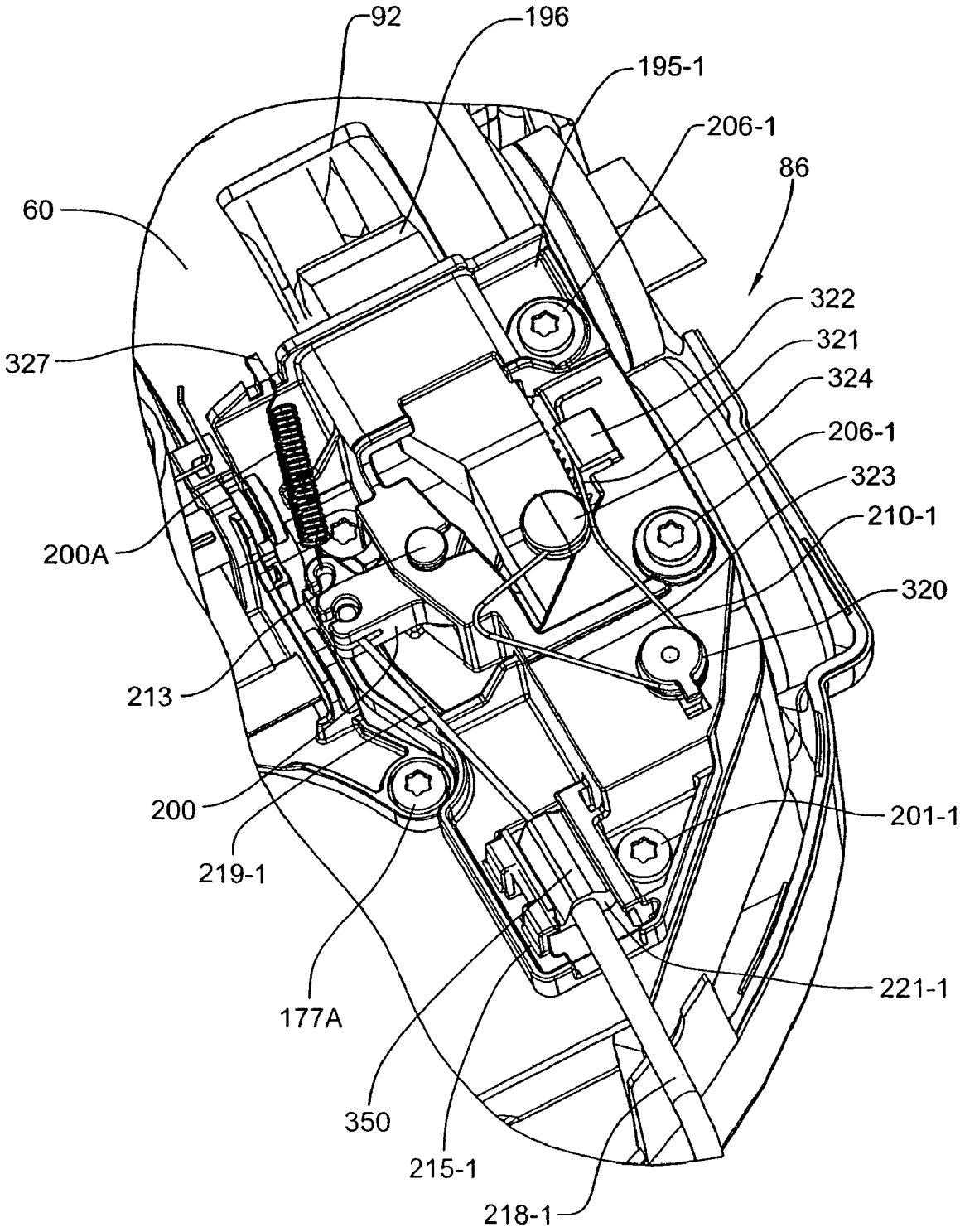
FIG. 51 is an enlarged partial view of the rear stop mechanism illustrating a preferred spring and cable connector arrangement.

More particularly as to FIGS. 31-33, the cover 195 includes fastener bores 201 which align with the fastener bores 96 of the body wall 60 so that the cover 195 is affixed to the control body 19 by fasteners 201-1 (FIG. 51). The cover 195 defines a guide chamber 202 in which the slide arm 196 is slidably received. As seen in FIG. 34, the slide arm 196 is able to slide longitudinally within this guide chamber 202 in the front-to-back direction wherein the engagement finger 197 abuts against the rear edge of the bracket opening 107 of the limit bracket 81. Thus, during the tilting of the chair 10, the limit bracket 81 pivots with the shaft 53 and pulls the slide arm 196 forwardly as generally indicated by reference arrow 203 (FIG. 34).

Figure 39:
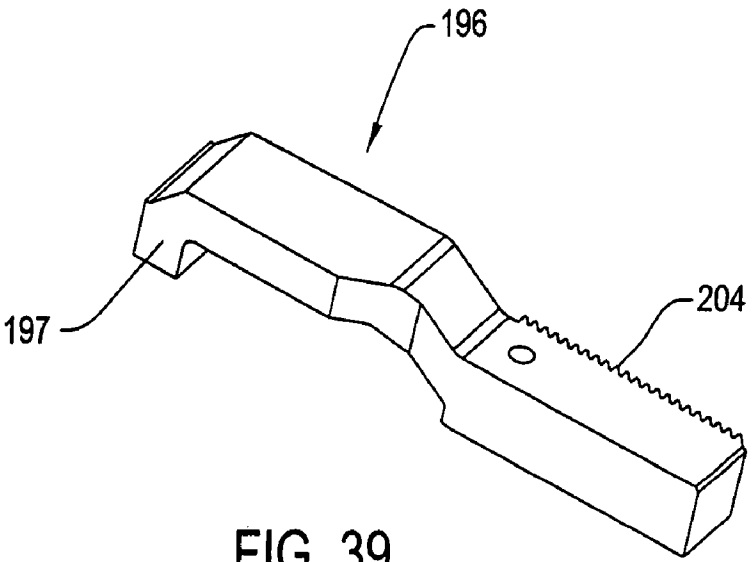
FIG. 39 is an isometric view of a movable stop arm.
Figure 40:
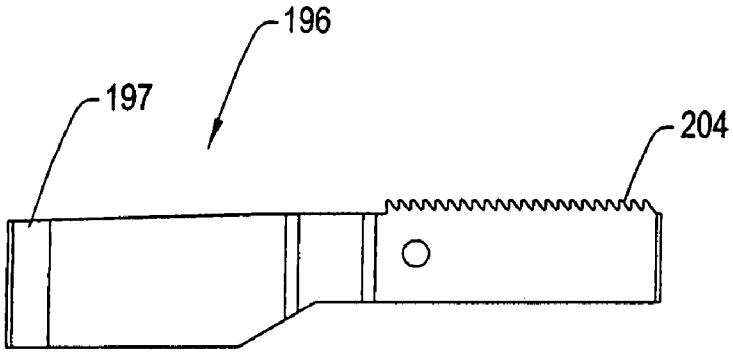
FIG. 40 is a plan view thereof.

Referring to FIGS. 39 and 40, the slide arm 196 includes the stop finger 197 at the front end thereof. A rear end section of the arm 196 includes locking teeth 204 on the side face thereof which are generally serrated and angle forwardly.

Figure 35:
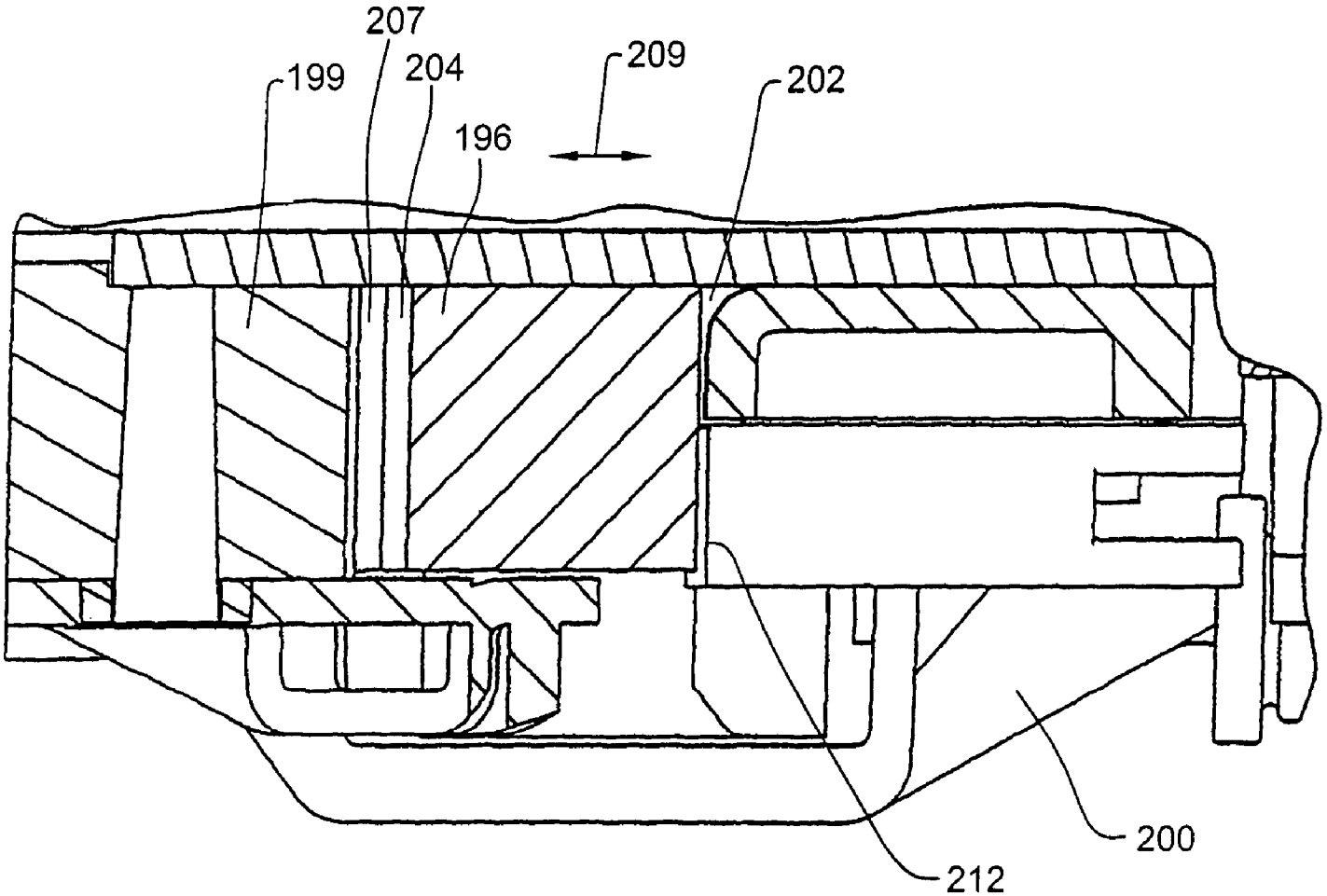
FIG. 35 is a front cross sectional view of the stop assembly.
Figure 36:
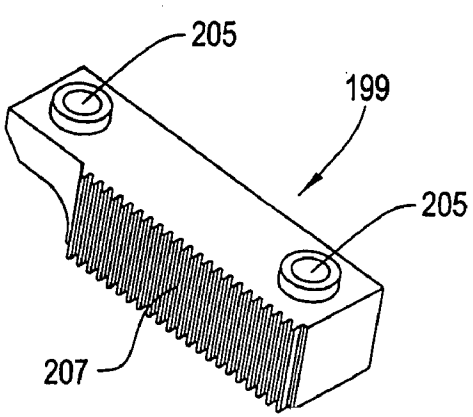
FIG. 36 is an isometric view of a fixed stop block.
Figure 37:
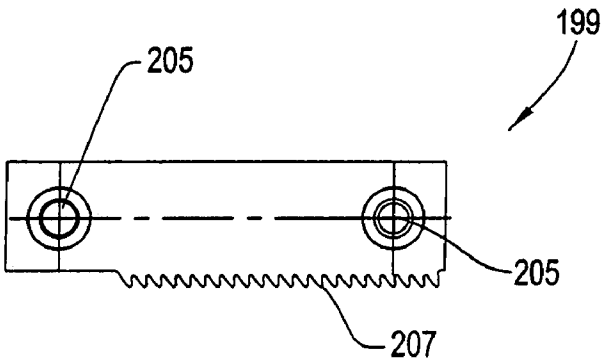
FIG. 37 is a plan view thereof.
Figure 38:
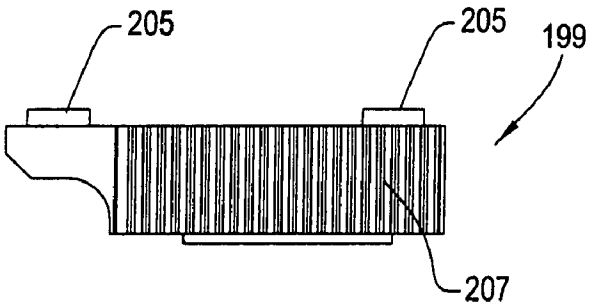
FIG. 38 is a side view thereof.

To affect locking of the arm 196 in a selected longitudinal position, the rear stop assembly 86 further includes the lock block 199 illustrated in FIGS. 36-38. A top of the lock block 199 has fastener bores 205 which are threadingly engaged by fasteners 206-1 threaded vertically through the fastener bores 206 (FIG. 33) of the cover 195. As such, the lock block 199 is affixed to the cover 195 and is disposed sidewardly adjacent to the slide arm 196 as seen in FIG. 35. The lock block 199 thereby is located in a fixed, non-movable position wherein the slide arm 196 may be axially slidable. The lock block 199 also includes serration-like teeth 207 which face sidewardly toward the teeth 204 of the arm 196.

In addition to longitudinal sliding of the arm 196, this arm 196 also is sidewardly movable as generally indicated by reference arrow 209 in FIGS. 31 and 35. The spring 210 is diagrammatically illustrated in FIG. 31 within the cover 195 which spring 210 acts on the arm 196 to normally bias and separate this arm 196 sidewardly away from the lock block 99 as seen in FIG. 31. This therefore allows the arm 196 to normally be slidable longitudinally as it is pulled forwardly by the limit bracket 81 during rearward tilting of the chair 10.

However, the arm 196 can be shifted sidewardly into engagement with the lock block 199 which therefore prevents relative sliding movement of the arm 196 at which time, the stop finger 197 will act upon the rear edge of the bracket opening 107. When the arm 196 is locked, this defines a stop location at which further rotation of the limit bracket 81 is prevented which thereby stops further rearward tilting of the back assembly 24 at this rear stop location.

To effect sideward locking displacement of the arm 196, the aforementioned cam 200 is provided. This cam 200 has a radially projecting cam surface 212. When this cam is rotated about its pivot pin 213, the cam surface 212 drives the arm 196 sidewardly into engagement with the lock block 199. In particular, the teeth 204 of the arm 196 engage the corresponding stationary teeth 207. When disposed in this locked position, the arm 196 is maintained at whatever longitudinal position it was at when it was displaced such that the rear stop location will vary depending upon the longitudinal position of the slidable arm 196. The cam 200 also connects to a spring 200A which generates a restoring torque thereto.

To effect rotation of the cam 200, the cover 195 includes a cable mount 215 which defines a center channel 216 and has serrated adjustment teeth 217 on each opposite side of the channel 216. This cable mount 215 is adapted to connect to a cable 218 that has an interior wire 219 that engages a corresponding opening 220 in the cam 200. To adjust the tension in the cable 218, the cable 218 includes a plastic connector block 221 having V-shaped resilient fingers 223. To locate this connector 221 in the cable mount 215, the resilient fingers 223 are resiliently pressed or pinched together during assembly and slid axially into the channel 216. Each of the fingers 223 includes serrated teeth 224 that engage the corresponding teeth 217 on the cable mount 215. The connector block 221 is illustrated in phantom outline in FIG. 33 at one exemplary position within the cable mount 215 although it is noted that the connector fingers 223 may be squeezed together and then slid to different longitudinal positions within the channel 216 to vary the overall tension on the cable 218.

This cable 221 is connected to one of the flipper levers 51 or 52 so that the cam 200 may be either engaged with the arm to lock the rear stop assembly 86 or disengaged so that the arm 196 separates from the lock block 199 and permits forward tilting of the chair 10 to the rearmost position defined by the flange 101 on the limit bracket 81.

Referring to FIG. 51, an alternate cover 195-1 is illustrated therein which is mounted to the control body plate 60 by the fasteners 201-1. This cover 195-1 includes the lock block 199 secured thereto by fasteners 206-1 which are engaged through the fastener bores 206 referenced above.

To bias the lever 196 sidewardly, a modified spring 210-1 is provided which is fixedly engaged to a post 320 on the cover 195-1. This spring 210-1 includes a first leg 321 that abuts against a tab 322 on the cover 195-1. The spring 210-1 further includes an additional spring leg 323 which cooperates with a vertically projecting pin 324 on the lever 196. This spring leg 323 further allows longitudinal sliding of the slidable leg 196 while also providing a longitudinal restoring force in addition to the sideward restoring force.

Still further, the cam 200 is illustrated in FIG. 51 as being rotatable about its respective pin 213 with the additional restoring spring 200A being connected thereto in tension. The opposite front end of the spring 200A is connected to a tab 327 on the cover 195-1, while cam 200 is further connected to the cable wire 219-1 of the cable 218-1 which pulls against the spring 200A. The most significant modification to the cover 195-1 is an improved cable mount 215-1 which is designed substantially the same as the cable mount 300 referenced above and which will be described in further detail herein relative to FIGS. 53-56.

To control the height of the chair 10, an additional actuator assembly 230 is illustrated in FIGS. 41-50. This actuator assembly 230 includes the aforementioned lever assembly 44 that is attached to the seat assembly 30 and includes the pivot lever 45. This lever assembly 44 actuates the actuator cable 45-1 which extends to an actuator mechanism 232 which mounts to the back wall 74 of the control body 19.

This actuator mechanism 232 comprises a fixed support block 233 and a rotatable drive block 234 as will be described in further detail herein. The fixed block 233 is mounted on the control body 19 with the cable 45-1 thereof extending to the exterior of the upper and lower covers 36 and 37 through the cable opening 38-2 (FIG. 6B) of the upper cover 37.

Figure 42:
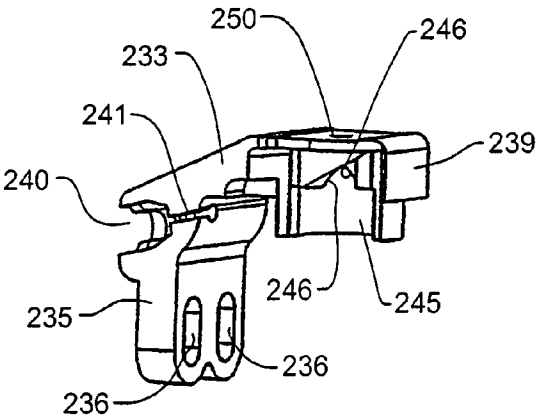
FIG. 42 is an isometric view of a fixed cam block for the pneumatic actuator.
Figure 49:
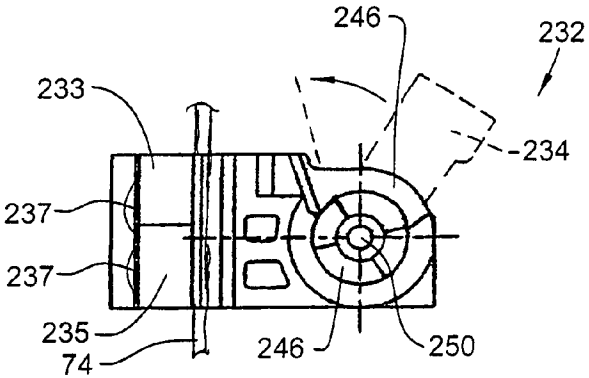
FIG. 49 is a bottom view of the pneumatic actuator assembly.
Figure 43:
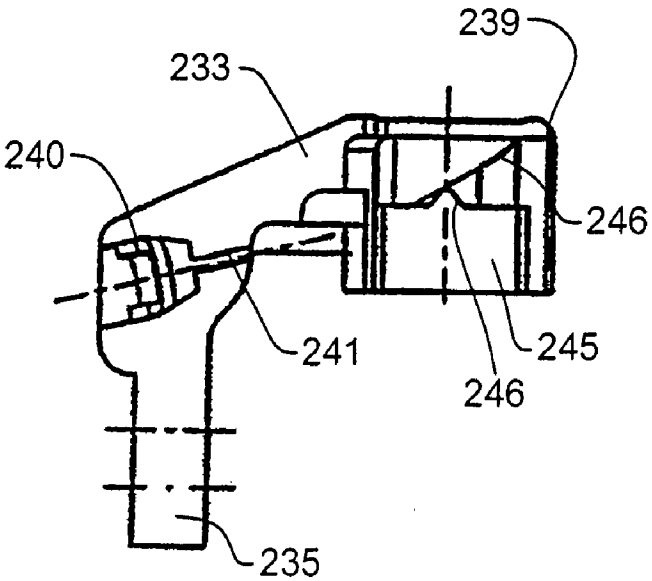
FIG. 43 is a side view of the fixed block.
Figure 44:
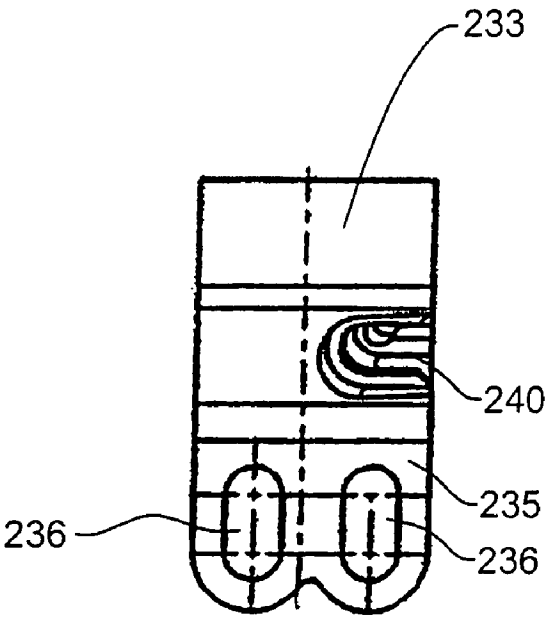
FIG. 44 is a rear view thereof.
Figure 45:
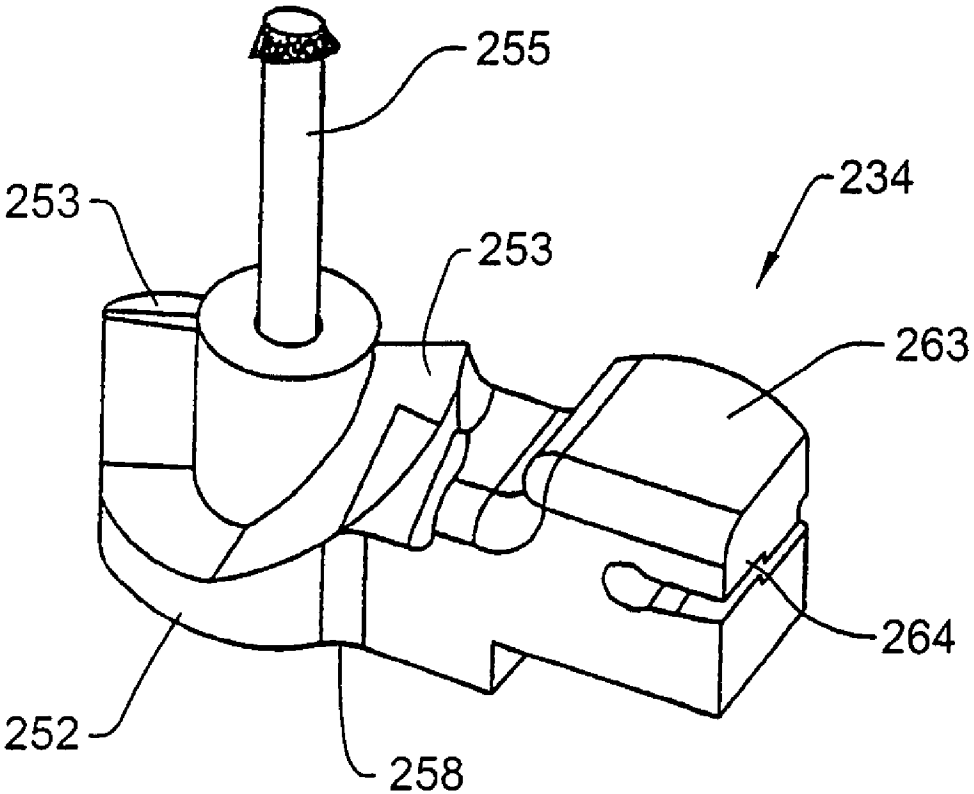
FIG. 45 is an isometric view of a rotating cam block.
Figure 46:
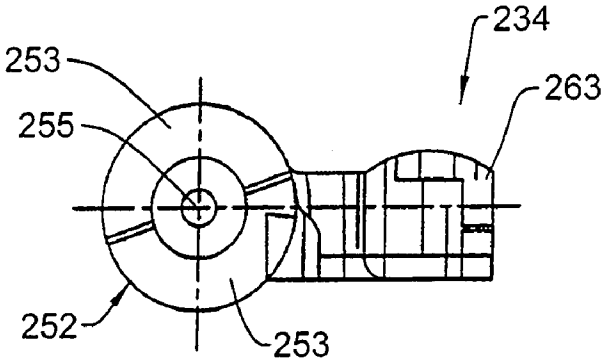
FIG. 46 is a plan view thereof.
Figure 47:
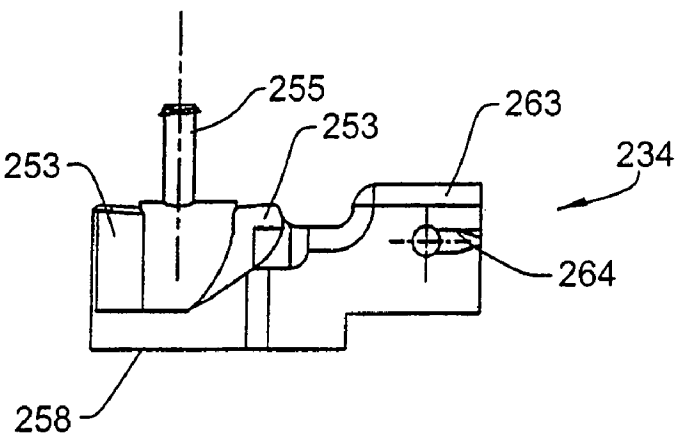
FIG. 47 is a first side view thereof.
Figure 48:
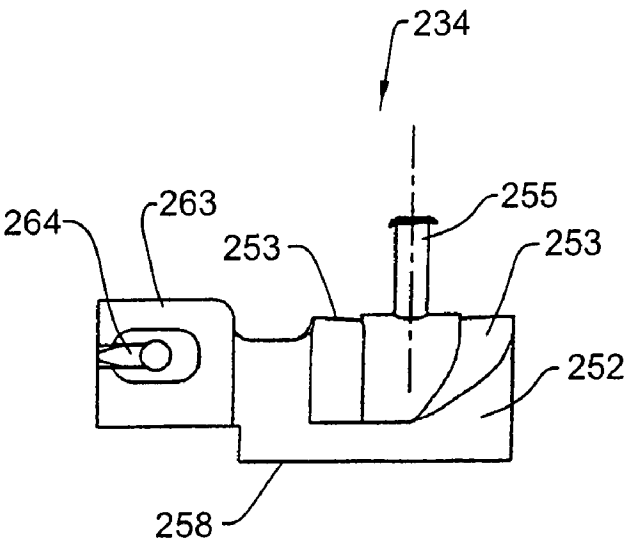
FIG. 48 is an opposite side view thereof.

Referring to FIGS. 42-44, the fixed block 233 includes a mounting body 235 having a pair of vertically elongate fastener slots 236 formed horizontally therethrough. These slots 236 align with the corresponding fastener bores 75 (FIG. 10) of the back housing wall 74 and are adapted to receive fasteners 237 to affix the fixed block 233 to this back body wall 74.

Figure 41:
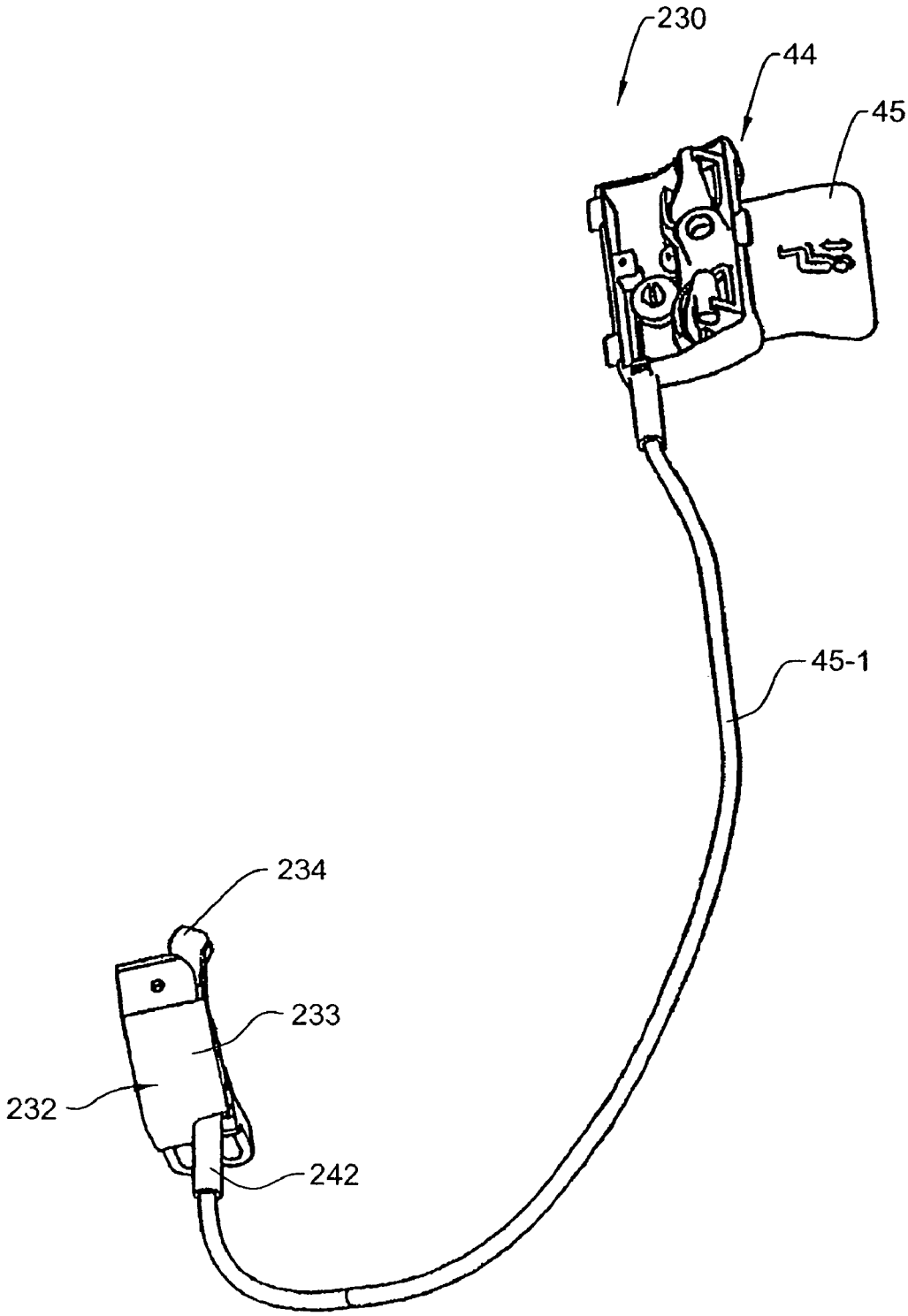
FIG. 41 is a cable assembly for a pneumatic actuator assembly.
Figure 50:
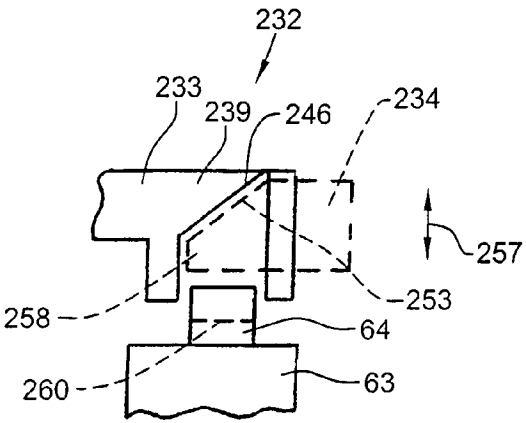
FIG. 50 is a diagrammatic side view thereof.

The fixed support block 233 further includes a cam section 239 which is configured so as to overly the pneumatic cylinder valve 64 of the pneumatic cylinder 63 (FIG. 50). Since the fastener slots 236 are vertically elongate, the vertical position of this cam section 239 relative to the valve 64 may be adjusted. The mounting section 235 also includes a cable connector groove 240 in one side which includes a thin slot 241 for receiving the cable therein. The channel 240 receives a mounting collar 242 of the cable 45-1 as seen in FIG. 41 which cable 45-1 is adapted to drive the rotatable block 234.

The cam section 239 includes a circular interior guide chamber 245 which opens downwardly and is disposed directly above the cylinder valve 64. At the upper end of this chamber 245, a pair of inclined cam surfaces 246 are disposed on opposite sides of the chamber 245 and face downwardly. This chamber 245 is adapted to rotatably receive the rotatable block 234 therein as generally indicated in phantom outline in FIG. 49. As such, the cam section 239 also includes a mounting bore 250 through the top thereof.

Referring to FIGS. 45-48, the rotatable block 234 includes a main cam body 252 that has a pair of inclined cam surfaces 253 formed thereon. These cam surfaces 253 are formed with an arcuate shape that conforms to the arcuate cam surfaces 246 of the fixed block 233. The main cam body 252 of the block 234 is adapted to fit upwardly into the cylindrical chamber 245 with the opposing cam surfaces 263 and 246 disposed in direct contact with each other.

To secure these blocks 233 and 234 together, the rotatable block 234 includes a connector shaft 255 which projects upwardly therefrom and snap fits into the corresponding connector bore 250 formed in the stationary block 233. This connector shaft 255 not only permits rotation of the rotatable block 234 relative to the fixed block 233 but also is vertically displaceable as generally indicated by reference arrow 257 in FIG. 50. Hence, when the rotatable block 234 is in the position illustrated in FIG. 49, this block 234 is at the elevation depicted in FIG. 50. While spaces are provided about the block 233 in FIG. 50 for clarity, it will be understood that the cam surfaces 253 thereof are in direct contact with the opposing cam surfaces 246 while the bottom surface 258 of the bock 234 is closely adjacent and preferably is in contact with the opposing upper surface of the actuator valve 64. Hence, rotation of the block 234 causes this block 234 to shift downwardly to depress the valve 64 to the release position generally identified in phantom outline by reference arrow 260. When in the depressed position 260, the valve 64 releases and permits the height of the chair 10 to be adjusted. The valve 64 also has a normal restoring force which biases the block 234 upwardly and returns the block 234 to the position illustrated in FIG. 49 when the cable mechanism is deactivated.

To activate this mechanism or rotate the rotatable block 234, this block 234 includes a drive arm 263 (FIGS. 45-48) that has a cable slot 264 formed horizontally therethrough. This cable slot 264 receives the end of the actuator cable 45-1 wherein pivoting of the actuator lever 45 causes rotation of the block 234 which thereby depresses the valve 64 to permit adjustment of the height of the chair 10. This arrangement of cooperating cam blocks 233 and 234 is able to translate horizontal movement of the cable 45-1 into vertical displacement of the valve 64 in a package which takes up minimal vertical and horizontal space within the interior of the tilt control mechanism 18.

Figure 53A:
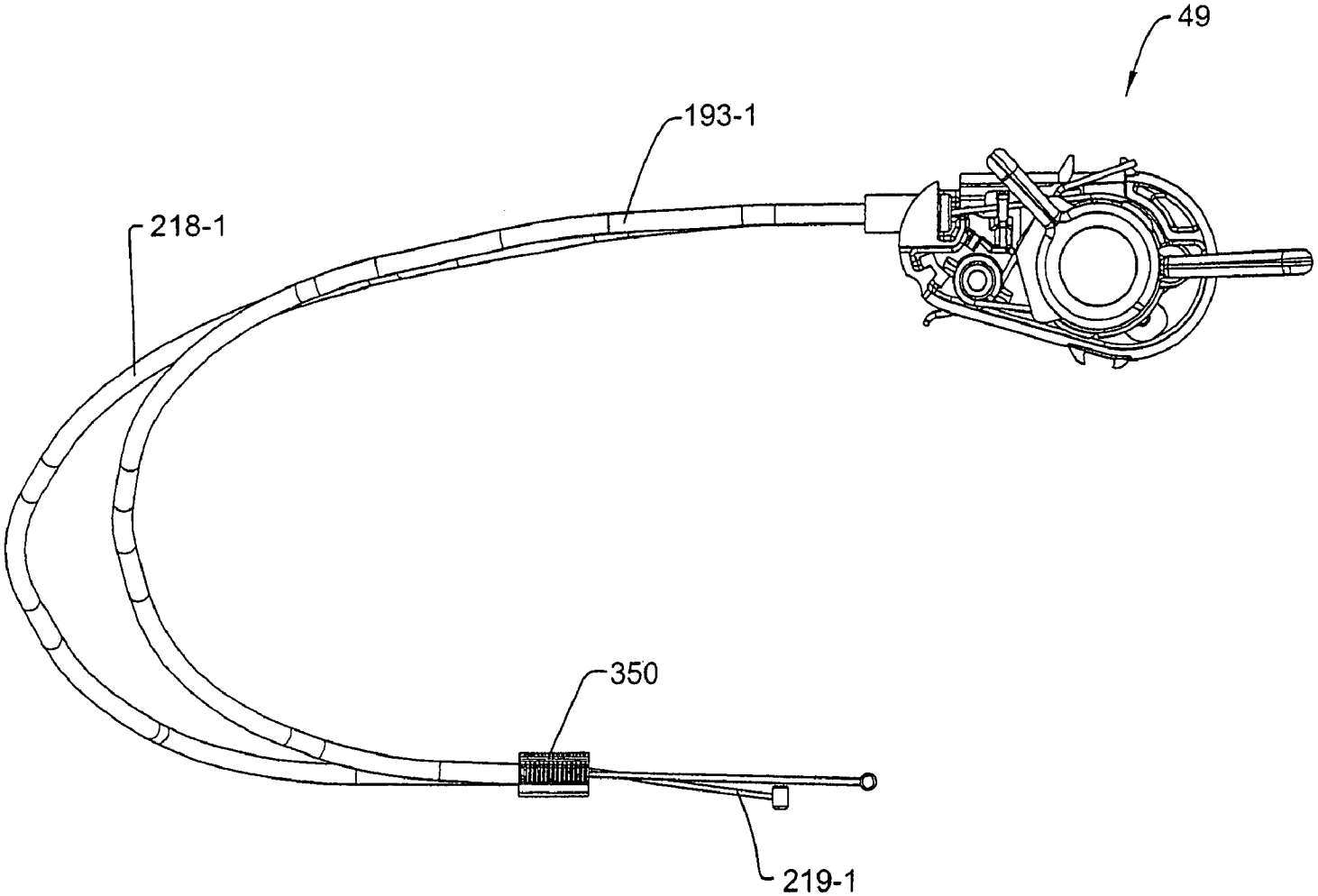
FIG. 53A is an enlarged view of a flipper handle and cable assembly for the front and rear stop assemblies.
Figure 53B:
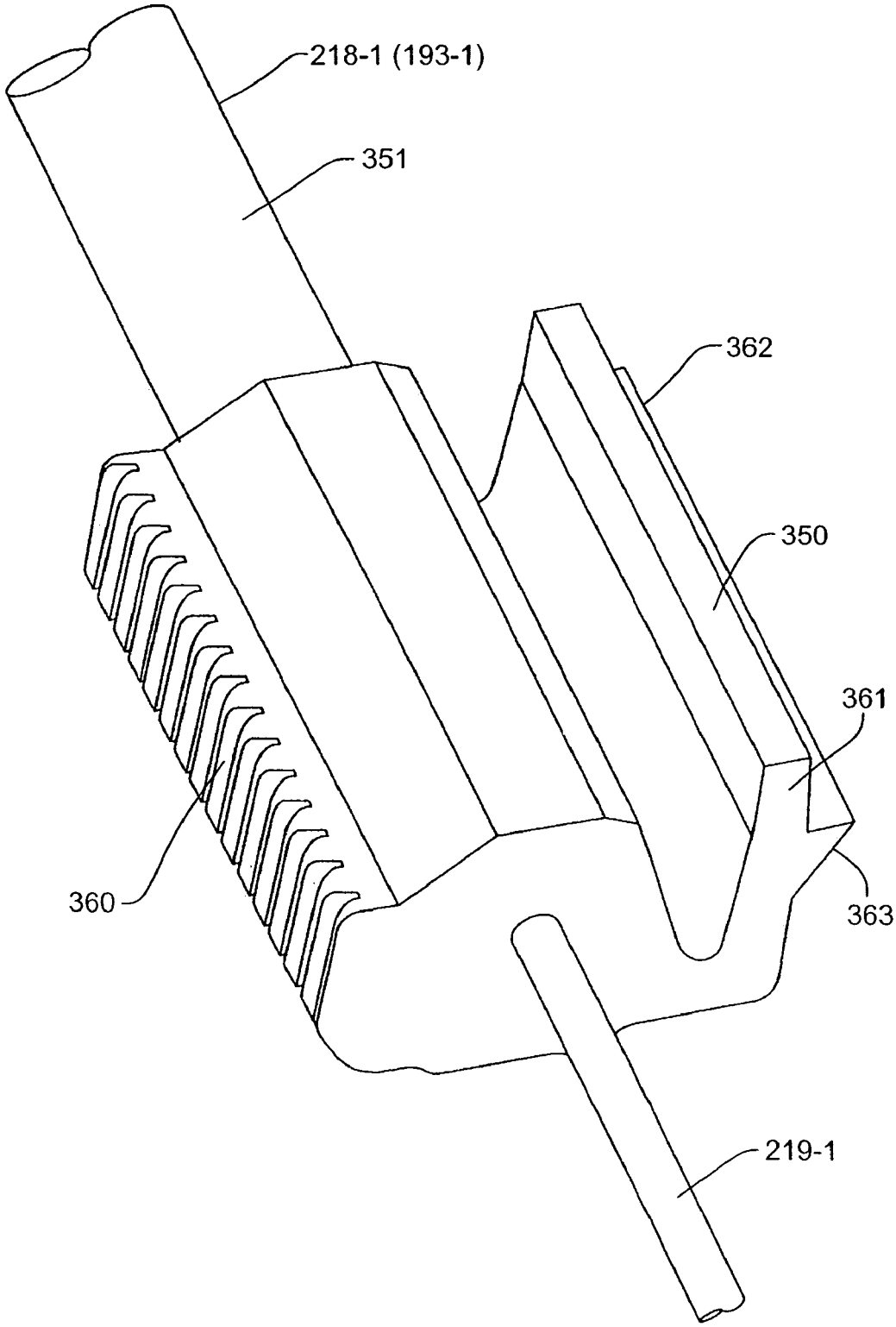
FIG. 53B is an enlarged view of an improved cable connector block.
Figure 53C:
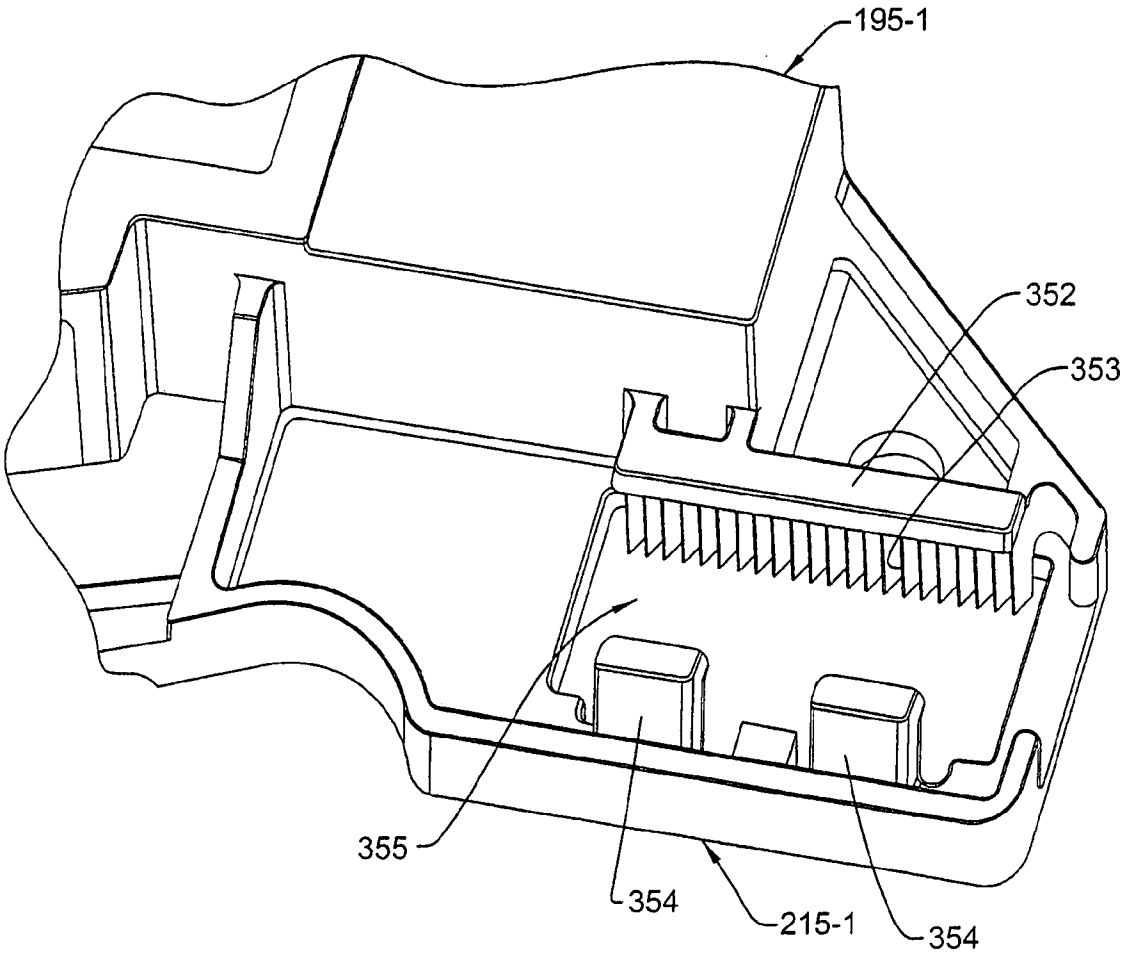
FIG. 53C is a partial enlarged view of the rear stop cover having an improved cable mount.

Turning next to the improved cable connector arrangement illustrated in FIGS. 53A-53C, the cable connector arrangement comprises two components, namely a connector block 350 which is provided on each of the outer sheaths of each actuator cable 193-1 and 218-1. This connector block 350 is adapted to connect to a respective one of the cable mounts 300 and 215-1 described above. The following discussion is primarily directed to the cable mount 215-1 with it being understood that the cable mount 300 is structurally and functionally the same and the following discussion is equally applicable to the cable mount 300.

More particularly, FIG. 53B illustrates the connector block 350 mounted to the outer sheath 351 of the cable 218-1 although the construction of the cable 193-1 is identical thereto, while FIG. 53C illustrates the cable mount 215-1 of the cover 195-1. This cable mount 215-1 includes an upstanding wall 352 which includes a row of serrated teeth 353 therealong. Opposite thereto, a plurality and preferably two upstanding tabs 354 are provided which project vertically and then inwardly towards the teeth 353. These tabs 354 and the opposing teeth 353 are spaced apart to define a slot 355 extending longitudinally therebetween in which the connector block 350 is snap-fittingly received.

With respect to the connector block 350, this connector block 350 includes a row of additional serrated teeth 360 which generally conform to and are adapted to mate within the above-described teeth 353. Opposite thereto, an upstanding wall or flange 361 is provided which includes a hook-like ledge 362 along the length thereof. This ledge 362 includes a camming surface 363 which is adapted to cam against the tabs 354 and snap therepast with the ledge 362 engaging the horizontal flanges of the tabs 354.

Figure 56:
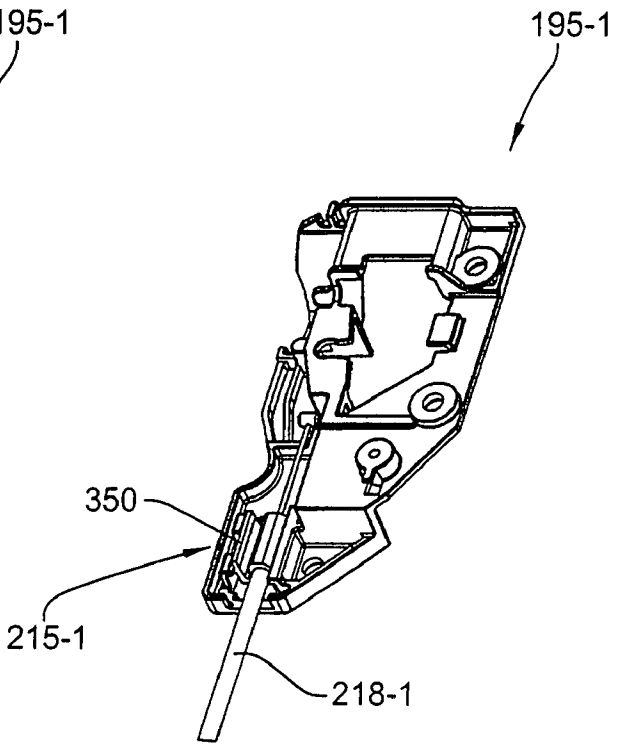
FIG. 56 illustrates the connector block in a fully seated position.
Figure 55:
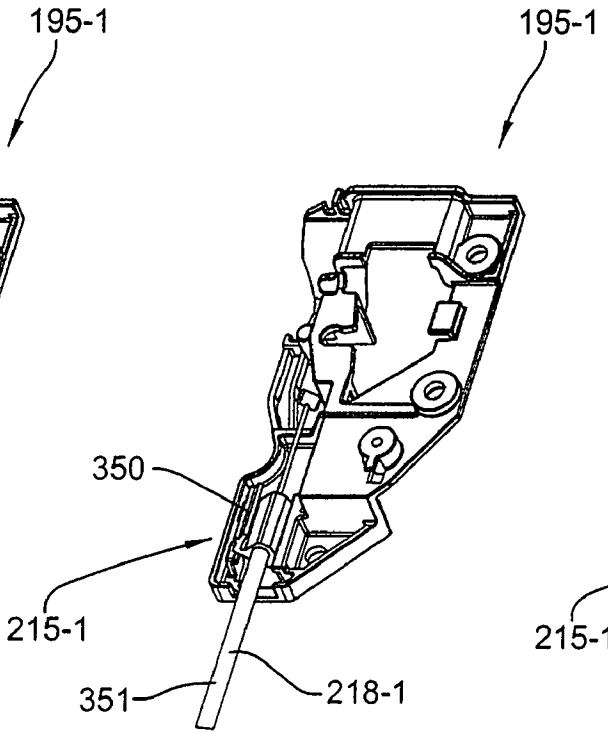
FIG. 55 illustrates the connector block in an intermediate insertion position.
Figure 54:
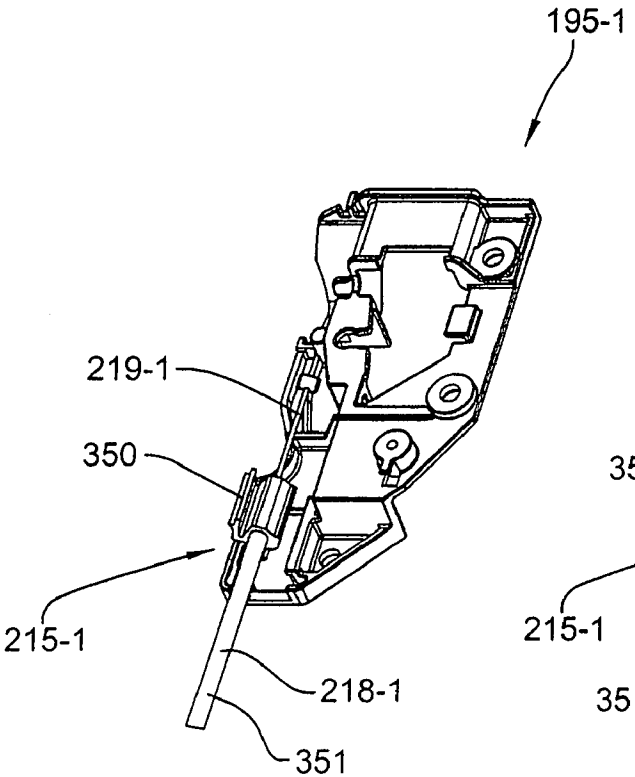
FIG. 54 is an isometric view illustrating the connector block being inserted into the rear stop cover.

Referring to FIGS. 54-56, the connector block 350 is engaged to the cable mount 215-1 by first inserting the serrated portion downwardly as seen in FIGS. 54 and 55, wherein the teeth 360 thereof engage the corresponding teeth 353 of the cover 195-1. Since the wire 219-1 is already connected to the above-described cam 200, the sheath 351 is pulled tight and the cable tension set by aligning the appropriate teeth 360 with the teeth 353. In this regard, the connector block 350 may be repositioned axially along the entire length of the teeth 353 at an appropriate location which provides appropriate cable tension. In the appropriate location, the snap flange 361 is then pressed downwardly until the ledge 362 snaps past the tabs 354 to the position illustrated in FIG. 56. The engaged teeth 353 and 360 thereby prevent longitudinal displacement of the connector block 350 and maintain the appropriate tension in the cables 218-1 or 193-1 in the case of the bracket 176-1. This connector block 350 thereby provides an improved connector arrangement as opposed to the above-described connector block 221 illustrated in FIGS. 32 and 33.

Figure 57:
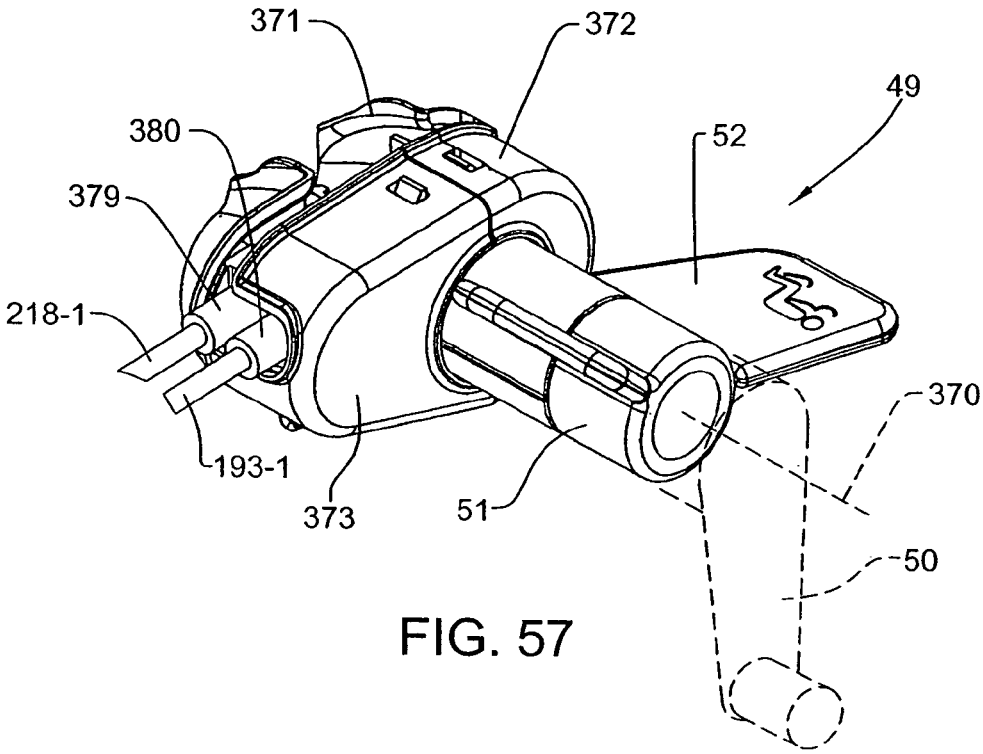
FIG. 57 is an isometric view of the actuator handle assembly with a crank illustrated in phantom outline.
Figure 59:
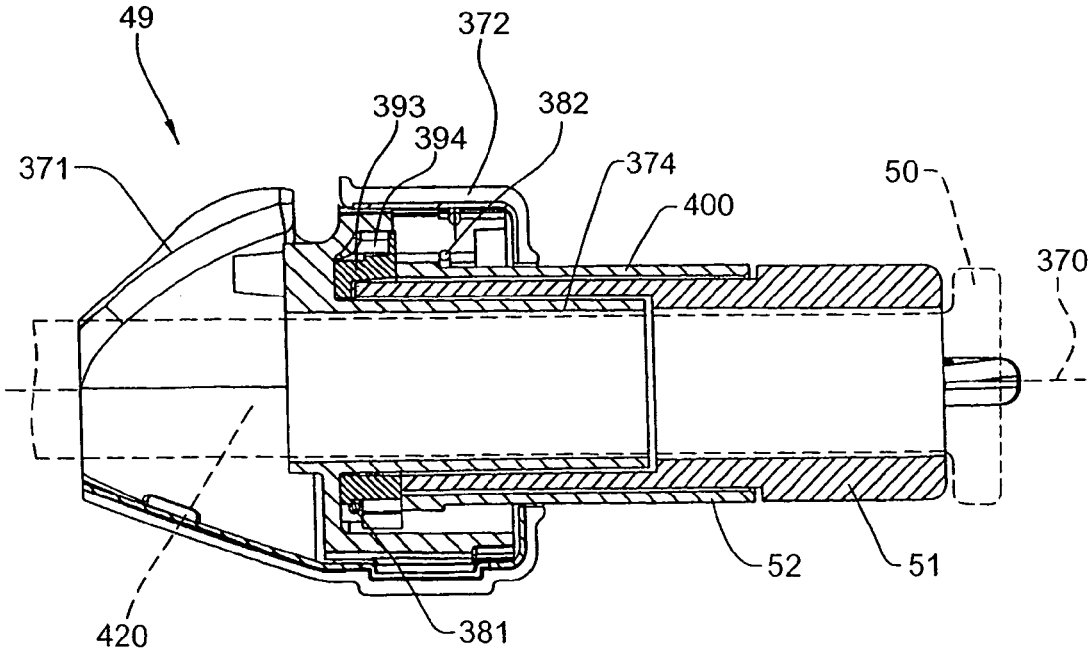
FIG. 59 is a rear cross-sectional view of the handle assembly.

Turning next to FIGS. 57-63, an improved handle assembly 49 is illustrated therein wherein all of the handles 50, 51 and 52 are rotatable coaxially about a common axis 370 (FIG. 57). Generally, the handle assembly 49 includes a main housing 371 which is adapted to connect to the chair control in a fixed position and additional removable covers 372 and 373. Referring to the main housing 371, this housing 371 includes a center guide shaft 374 which projects horizontally and rotatably supports the handles 51 and 52 as seen in FIG. 59. The support shaft 374 also includes an interior bore 375 which allows the crank handle 50 to project horizontally therethrough as illustrated in phantom outline in FIG. 59.

Figure 58:
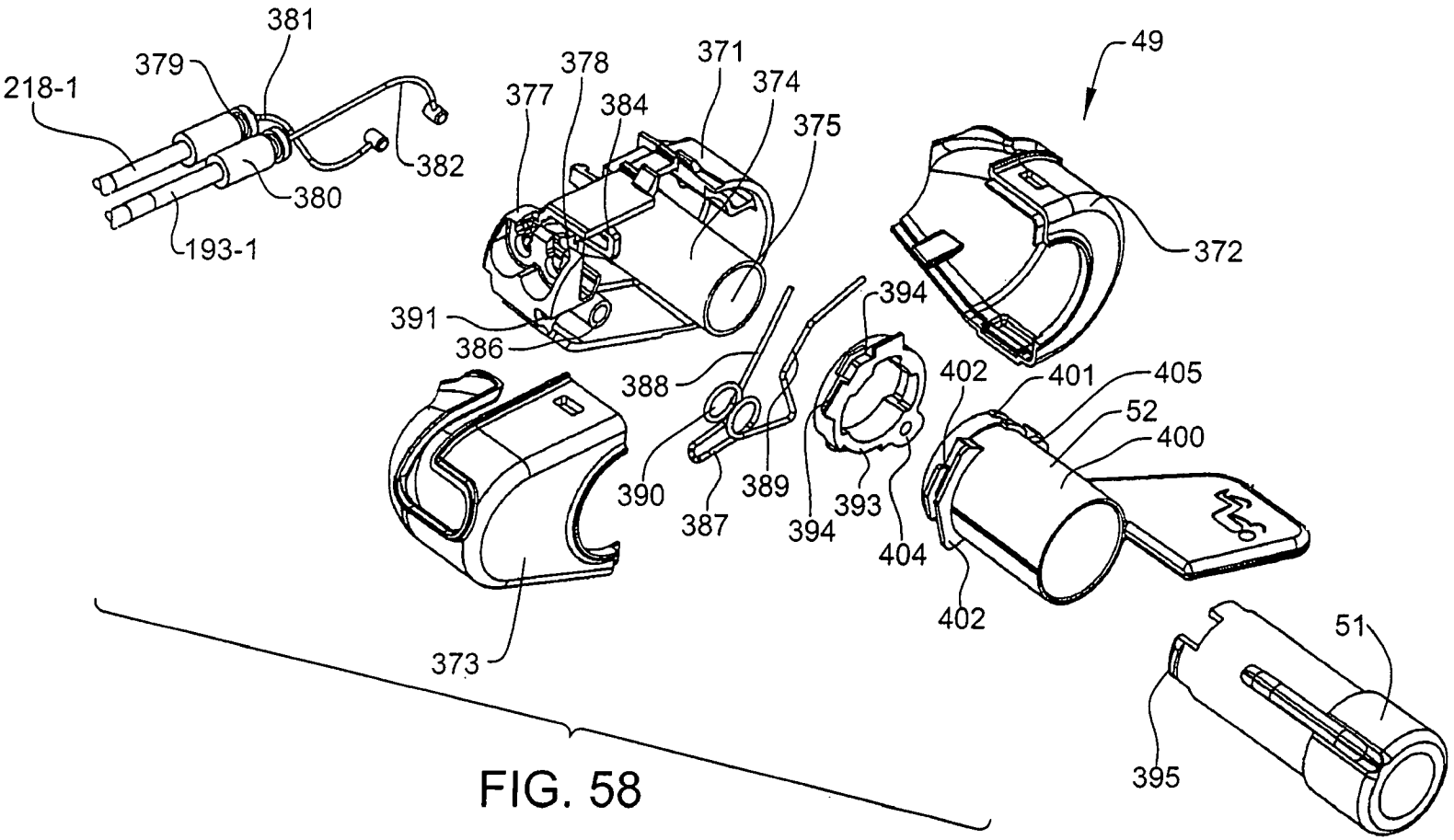
FIG. 58 is an exploded view of the handle assembly components.
Figure 60:
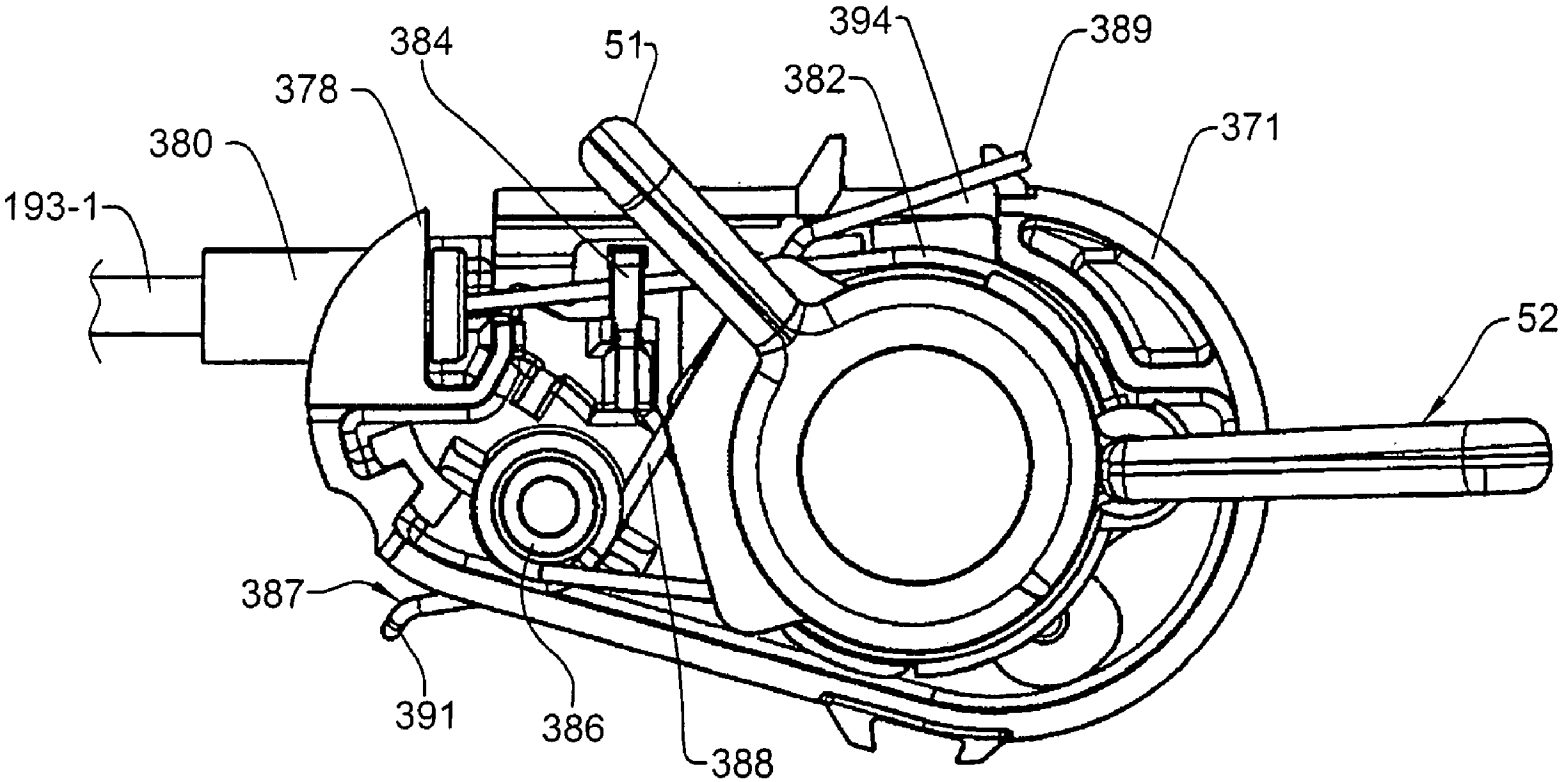
FIG. 60 is a side view of the handle assembly with covers removed.

The housing 371 also includes first and second cable sockets 377 and 378 which are adapted to fixedly support cable collars 379 and 378 that are provided on the ends of the sheaths of the cables 218-1 and 193-1 (FIG. 58). When the collars 379 and 380 are mounted in the sockets 377 and 378, the interior free ends 381 and 382 of the cable wires project into the interior of the housing 371 as will be described in further detail herein. In this regard, the housing 371 also includes a wire guide 384 which allows for the passage of wiring therethrough.

Still further, the housing 371 includes a spring support post 386 which is adapted to support a shaped spring 387 thereon. This shaped spring 387 includes a first spring leg 388 and a second spring leg 389, the function of which is described in further detail hereinafter. This spring 387 includes a coiled mounting portion 390 which fits onto the post 386 and a circumferentially extending tab 391 that projects through a corresponding slot 391 of the housing 371 to prevent rotation of the spring 387 when mounted in place. In operation, the first spring leg 388 cooperates with and serves as an over-center spring that governs rotation of the handle 51 while the second spring leg 389 cooperates with and governs over-center rotation of the other handle 52.

In this regard, the handle 51 includes a separate cam ring 393 which is fitted first over the support shaft 374 as can be seen in FIG. 59. This cam ring 393 cooperates with the spring leg 388 and includes a pair of facets or flats 394 on the outer circumference thereof. The innermost end of the handle 51 also includes a pair of tabs 395 which snap-lockingly engage the cam ring 393 so that the cam ring 393 and the associated handle 51 rotate in unison.

As to the other handle 52, this handle 52 includes a cylindrical body 400 that is adapted to slidably fit over the outer circumference of the handle 51 and rotate independently thereof. The inner end of the handle support body 400 also includes an integral ring-like cam structure 401 defined by a pair of facets or flats 402. These facets or flats 394 and 402 generally are flat and extend generally circumferentially wherein each adjacent pair of flats such as the flats 402 are oriented at an angle relative to each other which angle corresponds to the angular orientation of the spring legs 388 and 389.

Furthermore, these handles 51 and 52 are rotatable so as to displace the cable wires 381 and 382. In this regard, the cam ring 393 includes a wire connector 404 which projects radially while the handle body 400 also includes a similar wire connector 405 projecting radially therefrom.

Figure 61:
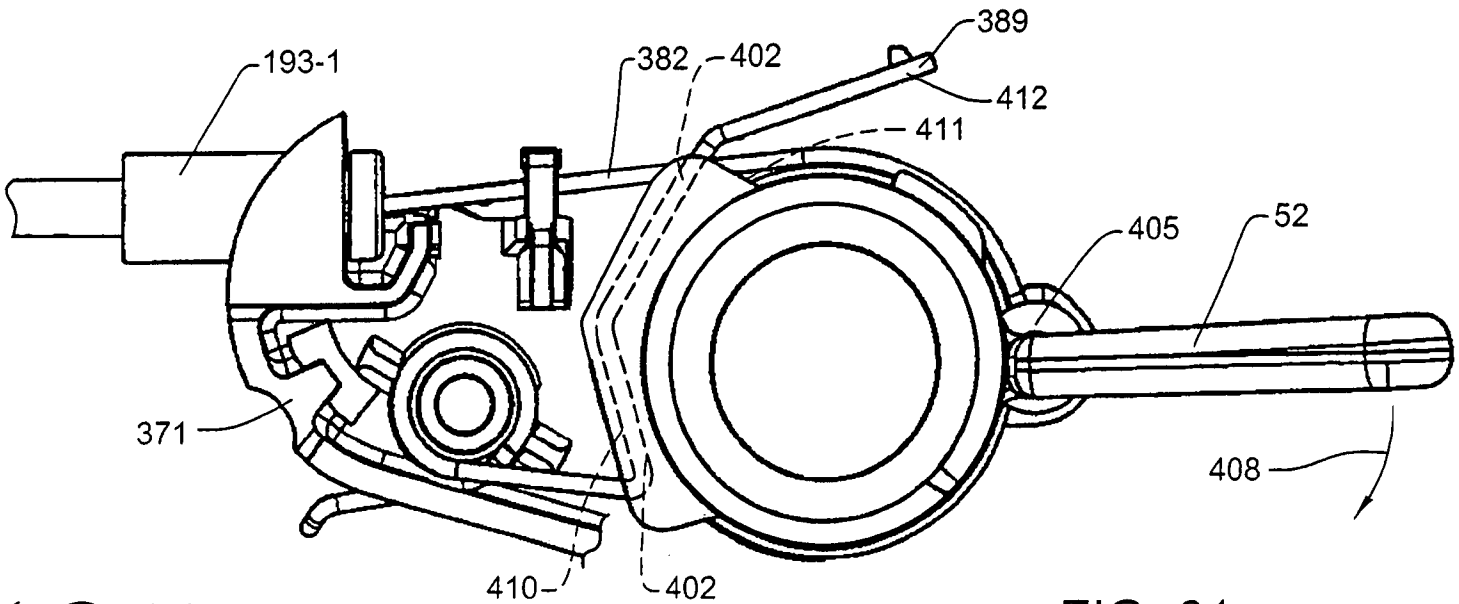
FIG. 61 is a partial side view of the flipper handle for the front stop assembly.
Figure 62:
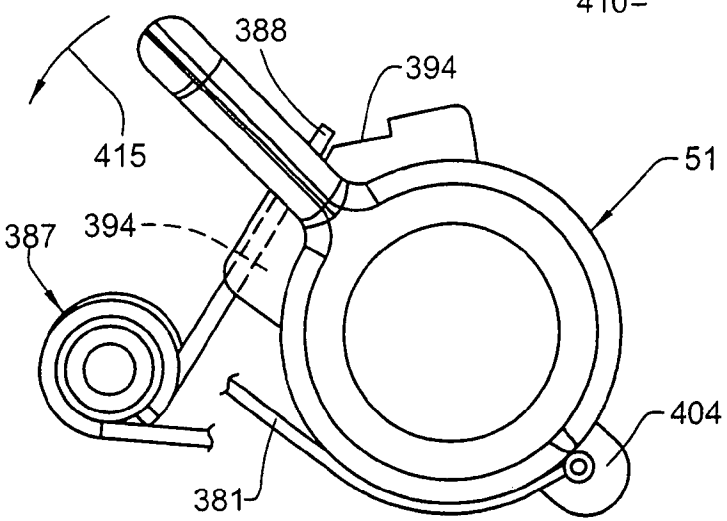
FIG. 62 is a partial enlarged view of the flipper handle for the rear stop assembly.
Figure 63:
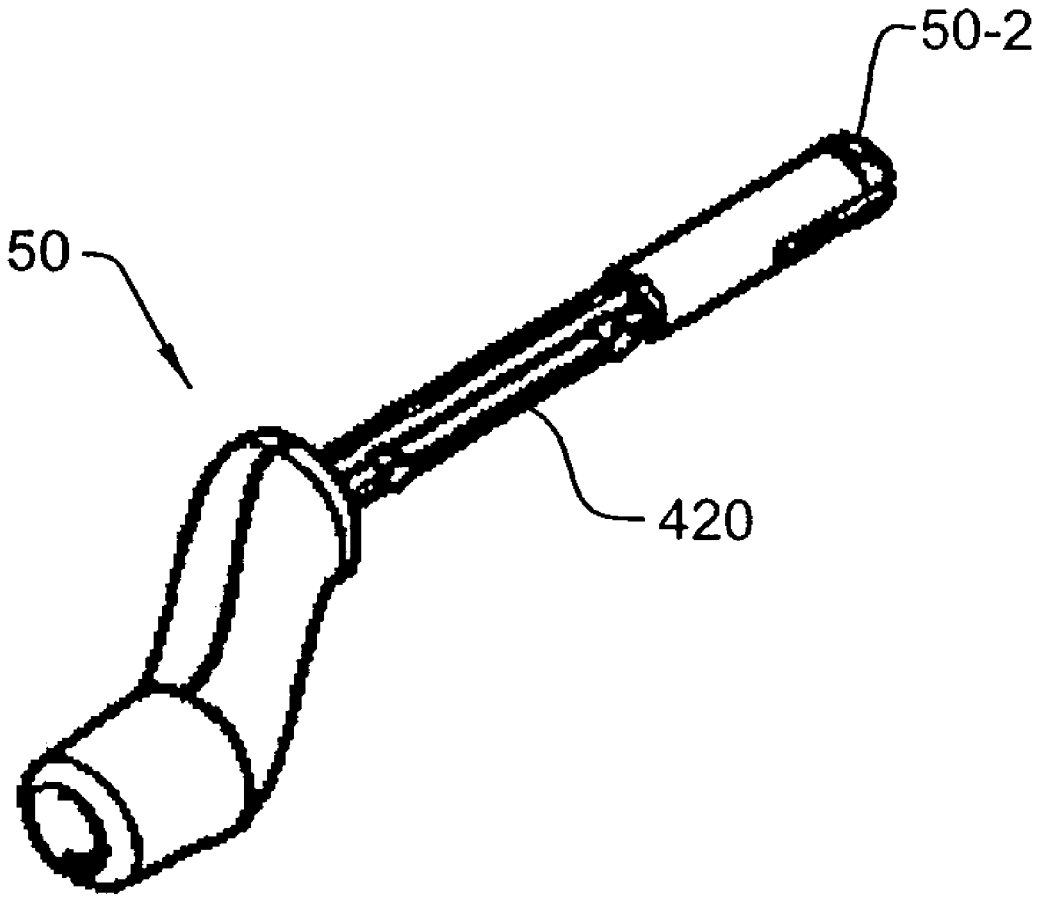
FIG. 63 is an isometric view of a tension adjustment crank.

In further detail as to the over-center operation of the respective handles 52 and 51, this operation is discussed herein relative to FIGS. 61 and 62. As to FIG. 62, this figure generally illustrates the housing 371 with the cable 193-1 connected thereto. Notably, the cable wire 382 extends circumferentially about the outside circumference of the handle body 400 in a clockwise direction with the terminal end of the wire 382 being connected to the wire connector 405 thereon. Therefore, clockwise rotation of the handle 52 in the direction of reference arrow 408 (FIG. 61) effects a pulling of the cable wire 382. The handle 52 essentially is operable through a plurality of positions and is maintained in this arrangement by the over-center cooperation of the spring leg 389 and the flats 402. In this regard, the spring leg 389 includes three sections 410, 411 and 412 with any two of these spring sections 410-412 being in contact with the flats 402. When the handle is rotated, the peak defined between the adjacent flats 402 snaps past the corresponding peak formed in the spring leg 389. Since the spring 389 may deflect radially, the handle 52 may snap between the operative positions of this handle 52 to engage and disengage the front stop arrangement.

Referring to FIG. 62, the handle 51 is operable in the counter-clockwise direction indicated by reference arrow 415. In this arrangement, the cable wire 381 wraps counter-clockwise about the outer circumferential surface of the cam ring 393 with the terminal free end engaged with the cable connector 404. Thus, counter-clockwise rotation of the handle 51 also effects a longitudinal pulling on the cable 381. It is desired that the handles 51 and 52 being engagable downwardly to perform the same function with respect to the front and rear stops and then upwardly to perform the same function of the respective stop mechanisms.

To maintain the handle 51 in one or the other of the operative positions, the spring leg 388 projects upwardly at an angle and engages one or the other of the flats 394. Thus, the cooperation of these flats 394 with the spring leg 388 effects over-center operation of the handle 51. Further, the handles 51 and 52 are both operable coaxially about the same axis 370. Additionally the crank 50 also is operable about the same axis. In particular, the crank 50 is illustrated in FIG. 63 and includes a horizontally elongate shaft 420 which extends through the hollow bore that extends through all of the handles 50 and 51 and the housing support shaft 374.

With this arrangement, an improved clustered handle assembly 49 is provided wherein all of the actuator handles are coaxially aligned and movable independently of each other.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A low-profile tilt control mechanism for a chair having a seat assembly and a back assembly interconnected by said tilt control mechanism such that said back assembly and said seat assembly are rearwardly reclinable from a normal tilt position, said tilt control mechanism comprising a control body and a chair frame member which is pivotally connected to said control body so as to pivot about a horizontal pivot axis during reclining of said seat assembly and said back assembly, said control body including a bottom wall, and said frame member including a control plate which moves in unison with said frame member wherein said control plate includes a plate surface extending in opposing relation with an opposing bottom wall surface of said bottom wall of said control body, said control plate including stop parts which move with said control plate along said bottom wall surface and said tilt control mechanism further including first and second stop mechanisms which are longitudinally elongate so as to lie along said bottom wall of said control body and each respectively having a low-profile engagement section which cooperates with a respective said stop part to selectively confine movement of said control plate and thereby limit movement of said seat assembly and said back assembly;

Said first stop mechanism defining a forward tilt control to limit forward tilting of said seat and back assemblies relative to the normal tilt position thereof; and Said second stop mechanism defining a rearward tilt control to limit rearward tilting of said seat and back assemblies relative to the normal tilt position thereof.

2. The tilt control mechanism according to claim 1, wherein a projection is provided on one of said control body and said control plate and an elongate window is provided on the other of said control body and said control plate to define a forwardmost limit and a rearmost limit of tilting of said seat and back assemblies relative to the normal tilt position.

3. The tilt control mechanism according to claim 1, wherein said control plate is rotatable about said pivot axis and includes control parts to control the total range of tilting of said seat and back assemblies, and said stop parts separately control forward tilting and rearward tilting of said seat and back assemblies relative to the normal tilt position.

4. The tilt control mechanism according to claim 1, wherein said first stop mechanism comprises an elongate lever which extends generally parallel to said bottom wall surface and is pivotally attached to said control body such that said respective engagement section is engagable and disengageable with said control plate upon pivoting movement of said lever.

5. The tilt control mechanism according to claim 4, wherein said control plate includes a window therein which extends in said plane of movement of said control plate so as to terminate at opposite window edges, said lever being engagable into or disengageable out of said window, wherein said engagement section is movable within said window when said lever is engaged with said control plate until such engagement section abuts against a respective one of said window edges which defines a said stop part to stop movement of said control plate and thereby stop tilting of said seat and back assemblies.

6. The tilt control mechanism according to claim 5, wherein said control plate is a rotatable plate connected to said frame member so as to rotate about said pivot axis.

7. The tilt control mechanism according to claim 4, which further includes a biasing member which biases said lever in a first direction and includes an actuator device which displaces said lever opposite to said biasing force.

8. The tilt control mechanism according to claim 1, wherein said second stop mechanism includes a slide member which is slidable along said control body wall surface and has said respective engagement section engaged with said control plate such that tilting of said seat and back assemblies effects sliding movement of said slide plate, said stop mechanism further including a lock mechanism which is releasably engagable with said slide plate to releasably prevent movement of said slide plate and releasably confine movement of said control plate so as to limit tilting of said seat and back assemblies.

9. The tilt control mechanism according to claim 8, wherein said slide plate confines movement of said control plate in one direction of movement of said control plate while permitting movement of said control plate in a direction opposite thereto.

10. A low-profile tilt control mechanism for a chair having a seat assembly and a back assembly interconnected by said tilt control mechanism such that said back assembly and said seat assembly are rearwardly reclinable from a normal tilt position, said tilt control mechanism comprising a control body and a chair frame member which is pivotally connected to said control body so as to pivot about a horizontal pivot axis during reclining of said seat assembly and said back assembly, said control body including a bottom wall and said frame member including a control plate which moves in unison with said frame member wherein said control plate includes a plate surface extending in opposing relation with an opposing bottom wall surface of said bottom wall, said control plate including a stop part which moves with said control plate along said bottom wall surface and said tilt control mechanism further including a stop mechanism which is longitudinally elongate so as to lie along said bottom wall of said control body and having a low-profile engagement section which cooperates with said stop part to selectively confine movement of said control plate and thereby limit movement of said seat assembly and said back assembly as said stop part moves with said control plate into cooperation with said engagement section, said stop mechanism comprising a slidable member which defines said engagement section and is slidable along said bottom wall surface during relative tilting of said seat and back assemblies, said slidable member being displaceable by tilting of said seat and back assemblies, and said stop mechanism further including a lock mechanism which is releasably engagable with said slidable member to prevent movement of said slidable member and thereby confine movement of said seat and back assemblies.

11. The tilt control mechanism according to claim 10, wherein said slidable member is movable through multiple positions and stopped in any one of said positions by said lock mechanism to define a selected stop position which limits rearward tilting of said seat and back assemblies.

12. The tilt control mechanism according to claim 11, wherein said lock mechanism is displaceable transversely relative to said slidable member into and out of engagement therewith.

13. A low-profile tilt control mechanism for a chair having a seat assembly and a back assembly interconnected by said tilt control mechanism such that said back assembly and said seat assembly are rearwardly reclinable from a normal tilt position, said tilt control mechanism comprising a control body and a chair frame member which is pivotally connected to said control body so as to pivot about a horizontal pivot axis during reclining of said seat assembly and said back assembly, said control body including a bottom wall and said frame member including a control plate which moves in unison therewith wherein said control plate includes a plate surface extending in opposing relation with an opposing wall surface of said bottom wall of said control body, said control plate including a stop part which moves with said control plate along said bottom wall surface and said tilt control mechanism further including a stop mechanism which is longitudinally elongate so as to lie along said bottom wall of said control body and having a low-profile engagement section which cooperates with said stop part to selectively confine movement of said control plate and thereby limit movement of said seat assembly and said back assembly, said control plate being rotatable about said pivot axis during tilting of said seat and back assembly, and said stop mechanism comprising a pivotable lever which is pivotally connected to said control body and is movable toward and away from said bottom wall to move said engagement section into and out of engagement with said control plate, said stop part and said engagement member comprising one or the other of a window and a projection wherein engagement of said projection with said window confines tilting of said seat and back assemblies.

14. The tilt control mechanism according to claim 13, wherein engagement of said projection with said window prevents forward tilting of said seat and back assemblies from the normal tilt position.

15. The tilt control mechanism according to claim 14, wherein said stop mechanism includes a biasing member which urges said lever out of engagement with said control plate to permit said lever and said control plate to remain engaged if binding occurs between said lever and said control plate.

16. In a chair having a chair control mechanism with first and second operative conditions and an actuator assembly for actuating said chair mechanism between said first and second operative conditions, said actuator assembly comprising an actuator cable having an outer sheath and an interior cable wire disposed therein, said actuator assembly further including a cable connector arrangement comprising a cable mount disposed proximate said chair control mechanism which said cable mount includes an elongate channel defined between channel side walls wherein at least one of said side walls includes a plurality of teeth extending in a longitudinal row, said cable connector arrangement further including a connector block mounted to said cable sheath which said connector block is selectively positionable within said channel in a fixed position, said connector block including a plurality of teeth adapted to cooperate with said teeth of said cable mount such that the longitudinal position of said connector block within said channel is adjustable, said connector block being insertable into said channel by manipulation of said block in a desired lengthwise position wherein said connector block is restrained in said position by interfitting engagement between said teeth of said connector block and said cable mount.

17. A cable connector arrangement according to claim 16, wherein said interior cable wire has a first end projecting outwardly of said connector block into engagement with said chair control mechanism.

18. A cable connector arrangement according to claim 17, wherein said actuator assembly includes an actuator and said interior cable wire is connected to said actuator wherein actuation of said actuator changes said chair control mechanism between said first and second operative conditions.

19. A cable connector arrangement according to claim 17, wherein said longitudinal position of said connector block adjusts a position of said outer sheath relative to said first end of said interior cable wire.

20. A cable connector arrangement according to claim 16, wherein said connector block includes resilient cantilevered fingers having said teeth disposed thereon wherein said fingers are pressable together to permit insertion into said channel and are biased outwardly to maintain said teeth of said connector block and said cable mount in interconnected engagement.

21. The cable connector arrangement according to claim 16, wherein said connector block has an engagement portion along one side thereof which is engagable with said cable mount and permits rotation of said connector block about a rotation axis parallel to the longitudinal axis of said cable wherein said rotation of said connector block rotates said connector block into said channel and engages said teeth of said connector block with said teeth of said cable mount.

22. The cable connector arrangement according to claim 21, wherein said engagement portion comprises an elongate rib which is hooked into engagement with a corresponding rib on said cable mount which said ribs define said rotation axis.

23. A clustered handle assembly for a chair, said chair having a multi-function control mechanism comprising first, second and third mechanisms, said handle assembly comprising:

a mounting body having an elongate guide shaft which defines a rotation axis extending axially therethrough, and first and second rotatable handles rotatably supported on an exterior surface of said guide shaft, said first rotatable handle being connected to said first mechanism and said second rotatable handle connected to said second mechanism, said guide shaft further including a bore extending coaxially therethrough wherein a third rotatable handle is disposed with a shaft thereof extending interiorly through said bore for rotation about said rotation axis, said third handle being connected to said third mechanism.

24. The clustered handle assembly according to claim 23, wherein said first and second mechanisms control front and rear stop positions defined by said control mechanism for forward and rearward tiling of said chair.

25. The clustered handle assembly according to claim 24, wherein said third mechanism controls resistance to tilting defined by said control mechanism which resists rearward tiling of said chair.

26. The clustered handle assembly according to claim 23, wherein said first, second and third rotatable handles rotate coaxially about said rotation axis.

27. The clustered handle assembly according to claim 23, wherein said second rotatable handle comprises a ring section on one end and a handle section on an opposite end which join together and rotate in unison, said ring section being disposed on one side of said first rotatable handle and said handle section being disposed another side of said first rotatable handle such that said second rotatable handle is rotatably supported over the exterior surface of said guide shaft of said mounting body, and said first rotatable handle rotates over an exterior surface of said second rotatable handle.

28. The clustered handle assembly according to claim 27, wherein said first and second handles respectively include circumferential first and second cam arrangements thereon which are each engaged by resiliently movable biasing sections, said biasing sections respectively cooperating with said first and second cam arrangements such that each of said first and second handles snap over center between first and second operative positions corresponding to plural operative conditions of said first and second mechanisms, said first cam arrangement being defined on said first rotatable handle, and said second cam arrangement being defined on said ring section.

29. The clustered handle assembly according to claim 23, wherein said first and second handles each include a circumferential cam arrangement thereon which are each engaged by resiliently movable biasing member, said biasing member cooperating with said cam arrangements such that each of said first and second handles snap over center between first and second operative positions corresponding to plural operative conditions of said first and second mechanisms.

30. The clustered handle assembly according to claim 29, wherein said biasing member has first and second biasing sections which respectively cooperate with said cam arrangement of said first and second rotatable handles.

31. The clustered handle assembly according to claim 30, wherein said cam arrangements each include flat facets extending circumferentially one next to the other and said first biasing section cooperates with said facets of said first rotatable handle and said second biasing section cooperates with said facets of said second rotatable handle.

32. The clustered handle assembly according to claim 31, wherein each of said cam arrangements includes a pair of said facets separated by an intermediate peak wherein the respective one of the first and second biasing sections reversibly travels over center from one of said facets over said peak to the other of said facets of said respective pair.

33. The clustered handle assembly according to claim 29, wherein said cam arrangements each include flat facets extending circumferentially one next to the other and said respective biasing member cooperates with said facets.

34. The clustered handle assembly according to claim 23, wherein first and second cables are connected to said mounting body in parallel relation, said mounting body further including cable guides which route interior cable wires of said cables in opposite circumferential directions about said guide shaft.

35. The tilt control mechanism according to claim 10, wherein said control plate includes a stop opening which moves with said control plate and defines said stop part, said engagement section of said slidable member extending into said stop opening and being relatively displaceable along said stop opening during movement of said control plate and relatively displaceable into contact with said stop part to define a stop limit at which movement of said seat assembly and back assembly is limited.

36. The tilt control mechanism according to claim 10, wherein said slidable member is movable by cooperation with said stop part of said control plate through multiple positions when said lock member is out of engagement with said slidable member, and wherein said slidable member is stopped in one of said positions when said lock member is engaged with said slidable member.

37. The tilt control mechanism according to claim 36, wherein said slidable member confines movement of said control plate in one direction of movement of said control plate while permitting movement of said control plate in a direction opposite thereto.

* * * * *